US012313373B2

(12) United States Patent
Underwood et al.

(10) Patent No.: US 12,313,373 B2
(45) Date of Patent: May 27, 2025

(54) HANDGUARD ASSEMBLY

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 90 days.

(21) Appl. No.: 18/094,358

(22) Filed: Jan. 8, 2023

(65) Prior Publication Data

US 2023/0221092 A1 Jul. 13, 2023

Related U.S. Application Data

(60) Provisional application No. 63/417,715, filed on Oct. 20, 2022, provisional application No. 63/322,059, filed on Mar. 21, 2022, provisional application No. 63/297,584, filed on Jan. 7, 2022.

(51) Int. Cl.
*F41C 23/16* (2006.01)
*F41A 21/48* (2006.01)

(52) U.S. Cl.
CPC ..... *F41C 23/16* (2013.01); *F41A 21/48* (2013.01)

(58) Field of Classification Search
CPC ..... F41C 23/16; F41A 21/48
USPC ..... 42/71.01
See application file for complete search history.

(56) References Cited

U.S. PATENT DOCUMENTS

| | | | |
|---|---|---|---|
| 3,355,833 | A | 12/1967 | Ruger et al. |
| 4,312,146 | A | 1/1982 | Koon, Jr. |
| 4,539,889 | A | 9/1985 | Glock |
| D285,236 | S | 8/1986 | Brunton |
| 4,879,827 | A | 11/1989 | Gentry |
| 4,941,394 | A | 7/1990 | Zedrosser et al. |
| 5,632,108 | A | 5/1997 | Ruger et al. |
| 5,913,261 | A | 6/1999 | Guhring et al. |
| 6,070,354 | A | 6/2000 | Burigana et al. |
| 6,298,594 | B1 | 10/2001 | Strayer |
| 6,604,311 | B1 | 8/2003 | Laney et al. |
| 6,640,479 | B2 | 11/2003 | Gühring et al. |
| 7,213,359 | B2 | 5/2007 | Beretta |
| 7,814,695 | B1 | 10/2010 | Keeney et al. |
| 7,832,326 | B1 | 11/2010 | Barrett |
| 8,141,287 | B2 | 3/2012 | Dubois |
| 8,230,634 | B1 | 7/2012 | Davies et al. |
| 8,316,756 | B1 | 11/2012 | Woodell et al. |
| 8,387,296 | B2 | 3/2013 | Overstreet et al. |
| 8,464,453 | B1 | 6/2013 | Ubl et al. |
| 8,479,635 | B2 | 7/2013 | Overstreet et al. |
| 8,789,305 | B1 | 7/2014 | DiChario |
| D713,483 | S | 9/2014 | Firpo et al. |
| 8,819,980 | B2 | 9/2014 | Geissele |
| D717,904 | S | 11/2014 | Oglesby |
| D720,032 | S | 12/2014 | Boutin |
| 8,910,406 | B1 | 12/2014 | Huang et al. |
| 9,032,860 | B2 | 5/2015 | Faxon |
| 9,052,149 | B2 | 6/2015 | Bender |

(Continued)

*Primary Examiner* — Samir Abdosh

(57) ABSTRACT

A handguard assembly for a firearm includes an outer member disposed forward of an upper receiver of the firearm where, a barrel nut disposed within the rear cavity, and at least one alignment member. The outer member includes a rear cavity and a threaded portion. The at least one alignment member contacts both the outer member and the upper receiver for alignment.

20 Claims, 30 Drawing Sheets

(56) References Cited

U.S. PATENT DOCUMENTS

| | | | | |
|---|---|---|---|---|
| 9,068,786 | B2 | 6/2015 | DiChario | |
| 9,297,599 | B2 | 3/2016 | Underwood et al. | |
| D760,860 | S | 7/2016 | Vincent et al. | |
| 9,389,033 | B1 | 7/2016 | Underwood et al. | |
| 9,453,694 | B1 | 9/2016 | Storch | |
| 9,494,382 | B2 | 11/2016 | Storch | |
| 9,863,730 | B2 | 1/2018 | Elftmann | |
| 9,952,011 | B2 | 4/2018 | Overstreet et al. | |
| 10,001,340 | B1 | 6/2018 | Oglesby | |
| 10,018,437 | B2 | 7/2018 | Phipps et al. | |
| 10,145,648 | B1 * | 12/2018 | Holder | F41C 23/16 |
| 10,180,298 | B2 | 1/2019 | Noonan | |
| 10,184,737 | B2 | 1/2019 | Roberts | |
| 10,295,304 | B1 * | 5/2019 | Kincel | F41G 11/003 |
| 10,436,549 | B1 * | 10/2019 | Taylor | F41C 23/16 |
| 10,598,454 | B2 | 3/2020 | DiChario et al. | |
| 10,641,563 | B2 | 5/2020 | Song et al. | |
| 10,670,360 | B2 | 6/2020 | Underwood et al. | |
| 10,670,369 | B1 * | 6/2020 | Ding | F41A 3/66 |
| 11,543,196 | B2 | 1/2023 | Underwood et al. | |
| 2005/0011098 | A1 | 1/2005 | Fagundes de Campos | |
| 2006/0207149 | A1 | 9/2006 | Lazor | |
| 2006/0283067 | A1 | 12/2006 | Herring | |
| 2011/0185614 | A1 | 8/2011 | Laney et al. | |
| 2011/0214327 | A1 | 9/2011 | DeSomma | |
| 2012/0023800 | A1 | 2/2012 | Laney | |
| 2012/0111183 | A1 | 5/2012 | Hochstrate et al. | |
| 2012/0137562 | A1 | 6/2012 | Langevin et al. | |
| 2012/0167424 | A1 | 7/2012 | Gomez | |
| 2013/0174457 | A1 | 7/2013 | Gangl et al. | |
| 2013/0219763 | A1 | 8/2013 | Nunes | |
| 2014/0000142 | A1 | 1/2014 | Patel | |
| 2014/0224114 | A1 | 8/2014 | Faxon | |
| 2014/0230297 | A1 | 8/2014 | Larson et al. | |
| 2014/0331535 | A1 | 11/2014 | Robinson et al. | |
| 2014/0352191 | A1 | 12/2014 | Fritz et al. | |
| 2015/0000171 | A1 | 1/2015 | Roberts | |
| 2015/0020426 | A1 | 1/2015 | Neergaard | |
| 2015/0101230 | A1 | 4/2015 | Curtis | |
| 2016/0054085 | A1 | 2/2016 | Miller, III | |
| 2016/0327357 | A1 | 11/2016 | Wheatley | |
| 2017/0160048 | A1 * | 6/2017 | Galletta, II | F41A 21/48 |
| 2017/0299303 | A1 | 10/2017 | Phipps et al. | |
| 2018/0023924 | A1 | 1/2018 | Storch | |
| 2018/0087859 | A1 | 3/2018 | Underwood et al. | |
| 2018/0202757 | A1 * | 7/2018 | Samson | F41A 21/48 |
| 2018/0202758 | A1 * | 7/2018 | Samson | F41A 21/48 |
| 2018/0306551 | A1 * | 10/2018 | Reid | F41A 21/485 |
| 2018/0347924 | A1 | 12/2018 | Satern | |
| 2018/0356181 | A1 * | 12/2018 | Williams | F41G 11/003 |
| 2019/0086168 | A1 | 3/2019 | Song et al. | |
| 2019/0101355 | A1 * | 4/2019 | Hubbell | F41C 23/16 |
| 2019/0170476 | A1 * | 6/2019 | Hiler, Jr. | F41A 21/482 |
| 2019/0226779 | A1 | 7/2019 | DiChario et al. | |
| 2019/0277598 | A1 * | 9/2019 | Kincel | F41A 5/18 |
| 2020/0256636 | A1 | 8/2020 | Martini | |
| 2021/0293498 | A1 * | 9/2021 | Underwood | F41A 3/66 |
| 2022/0018629 | A1 * | 1/2022 | Senff | F41C 23/18 |
| 2023/0026346 | A1 * | 1/2023 | Risley | F41C 23/16 |
| 2023/0221092 | A1 * | 7/2023 | Underwood | F41A 21/48 42/71.01 |
| 2023/0324140 | A1 * | 10/2023 | Olsen | F41C 23/16 42/72 |
| 2024/0003654 | A1 * | 1/2024 | Boomgaarden | F41C 23/16 |

* cited by examiner

HANDGUARD ASSEMBLY

CROSS REFERENCE TO RELATED APPLICATIONS

This application is related to and claims priority benefit from U.S. Provisional Application No. 63/297,584 ("the '584 application"), filed on Jan. 7, 2022; U.S. Provisional Application No. 63/322,059 ("the '059 application"), filed on Mar. 21, 2022; and U.S. Provisional Application No. 63/417,715 ("the '715 application"), filed on Oct. 20, 2022. The '584 application, the '059 application, and the '715 application are each hereby incorporated in their entirety by this reference.

FIELD OF THE INVENTION

The field of the invention relates to firearms, particularly handguard assemblies and related manufacturing methods.

BACKGROUND

Many modern firearms and firearm accessories (including handguns, rifles, carbines, shotguns, etc.) are designed based on existing modular firearm systems. For example, many firearms and related accessories are designed for compatibility with (i) the AR-15 variant (civilian) or M16/M4 (military) firearm platform and/or (ii) the AR-10 variant firearm platform. Many of these products follow traditional designs based on industry standards and/or military specifications (milspec). To provide a handhold for the operator's forward (non-shooting) hand and to facilitate mounting accessories (including sights, optics, lights, and/or other objects), many firearms are designed with (or to be compatible with) a handguard that is attached as a separate component at the forward end of the upper receiver. However, existing handguards are often difficult to install and/or costly to manufacture.

To maximize manufacturing efficiency, reduce cost, and simplify installation while increasing firearm accuracy, it may be desirable to design new handguard assemblies.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present invention, a handguard assembly for a firearm comprises: an outer member disposed forward of an upper receiver of the firearm, the outer member comprising a rear cavity and a threaded portion; a barrel nut disposed within the rear cavity; and at least one alignment member, wherein the at least one alignment member contacts both the outer member and the upper receiver for alignment.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments in FIGS. 1-27B show components of various semi-automatic or automatic firearms, the features, concepts, and functions described herein are also applicable (with potential necessary alterations for particular applications) to handguns, rifles, carbines, shotguns, or any other type of firearm, including firearms that operate manually (e.g., bolt action, lever action, or other relevant firearms). Furthermore, the embodiments may be compatible with various calibers including rifle calibers such as, for example, 5.56×45 mm NATO, 0.223 Remington, 7.62×51 mm NATO, 0.308 Winchester, 7.62×39 mm, 5.45×39 mm, 7.62×35 mm, 6.5×39 mm, 6.8×43 mm, 11.63×40 mm, 0.50 Beowulf; pistol calibers such as, for example, 9×19 mm, 0.45 ACP, 0.40 S&W, 0.380 ACP, 10 mm Auto, 5.7×28 mm, 0.22 Long Rifle; and shotgun calibers such as, for example, 12 gauge, 20 gauge, 28 gauge, 0.410 gauge, 10 gauge, 16 gauge. The illustrated embodiments focus on an upper receiver for the AR-15 variant (civilian) or M16/M4 (military) firearm platform (i.e., AR-15 style firearms); however, the concepts and features described herein can be are also applicable (with potential necessary alterations for particular applications) to other components of AR-15 style firearms and to components of other firearms. The handguard assemblies 100, 1000, 2000 may be designed to function and engage with (i) components of AR-15 style firearms; (ii) components of AR-10 variant firearms; and/or (iii) components of any other relevant firearm.

Figure 1:
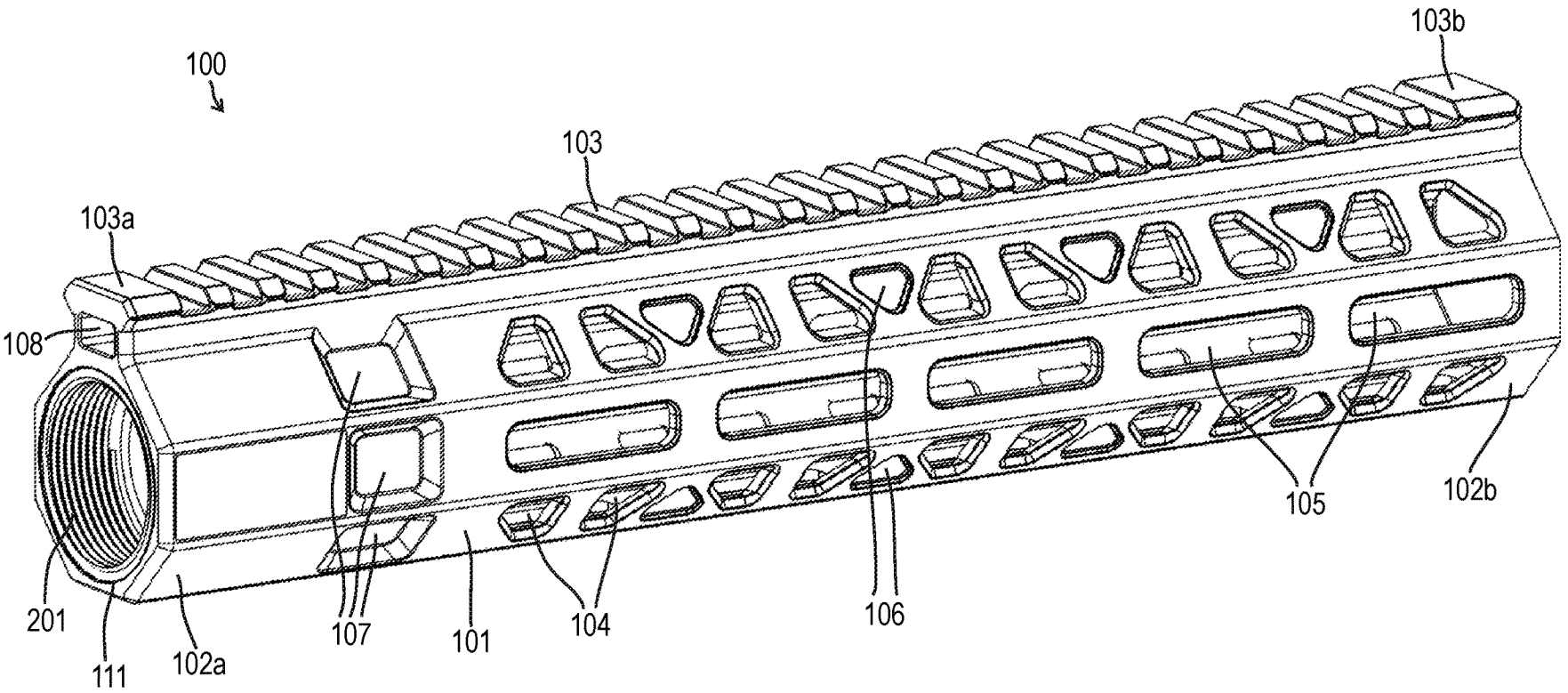
FIG. 1 is a right rear perspective view of a handguard assembly for a firearm according to certain embodiments of the present invention.
Figure 2:
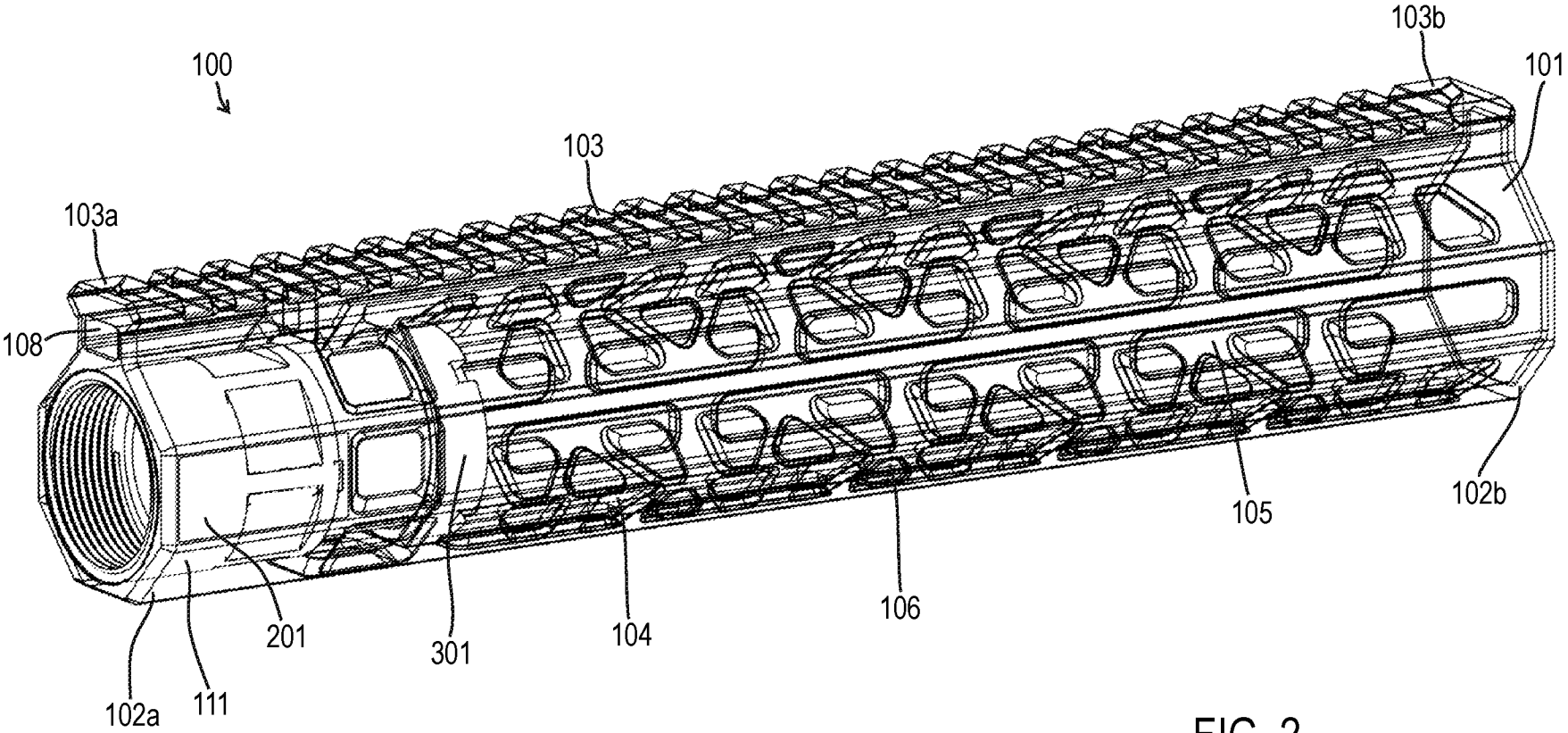
FIG. 2 is a right rear perspective view of the handguard assembly of FIG. 1.
Figure 3:
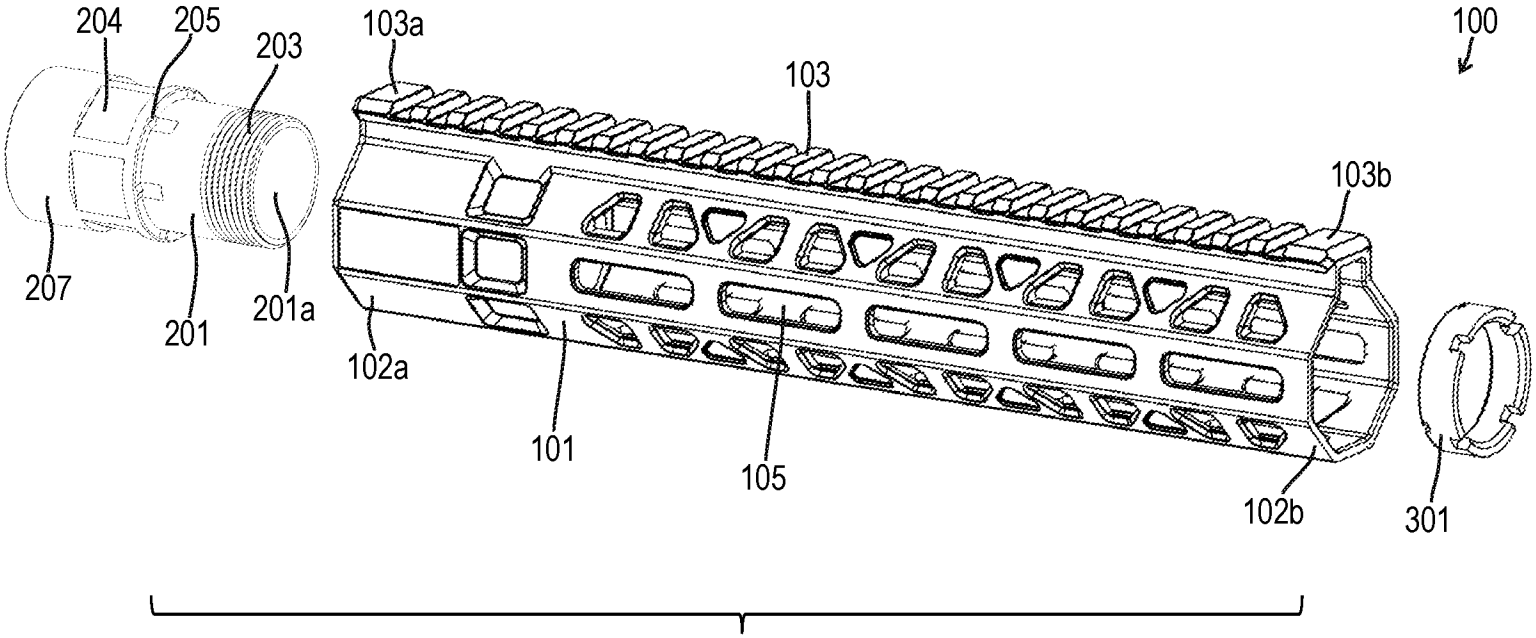
FIG. 3 is an exploded perspective view of the handguard assembly of FIG. 1.
Figure 4A:
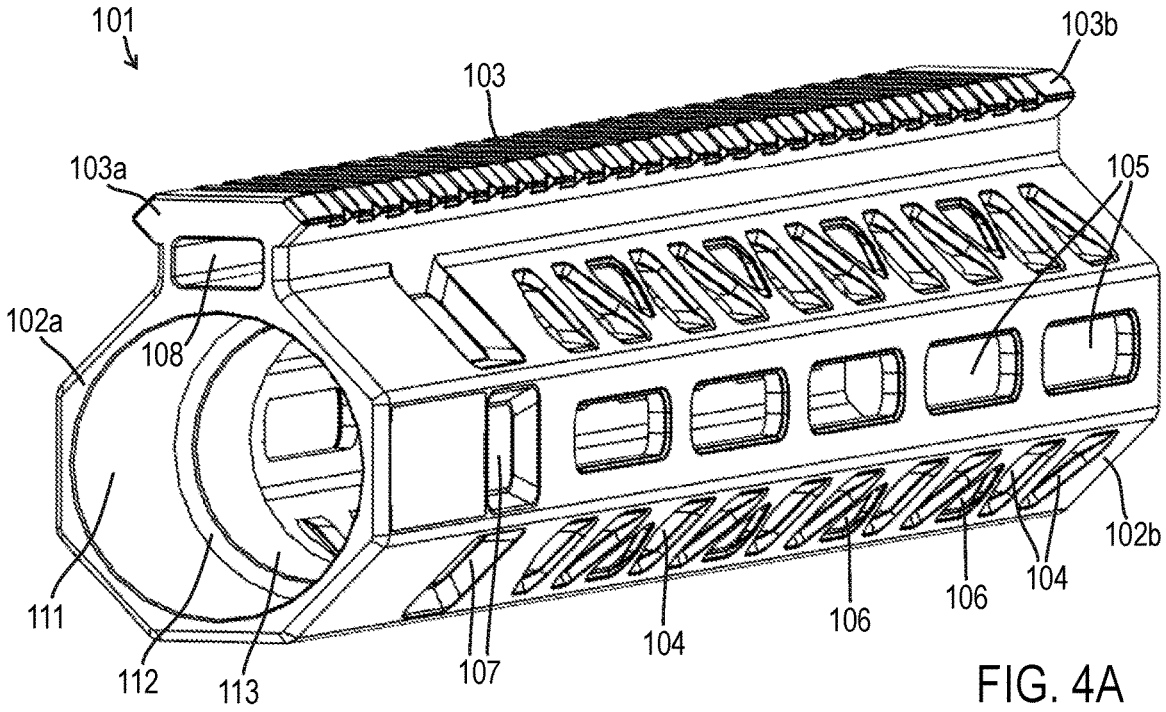
FIG. 4A is a right rear perspective view of an outer member of the handguard assembly of FIG. 1.
Figure 4B:
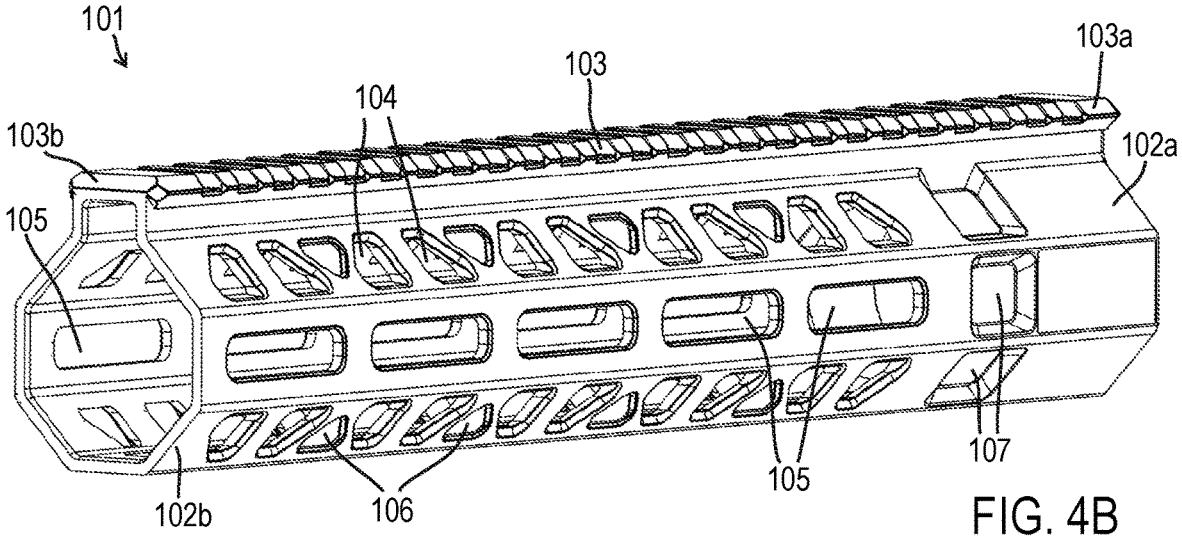
FIG. 4B is a left front perspective view of the outer member of FIG. 4A.
Figure 4C:
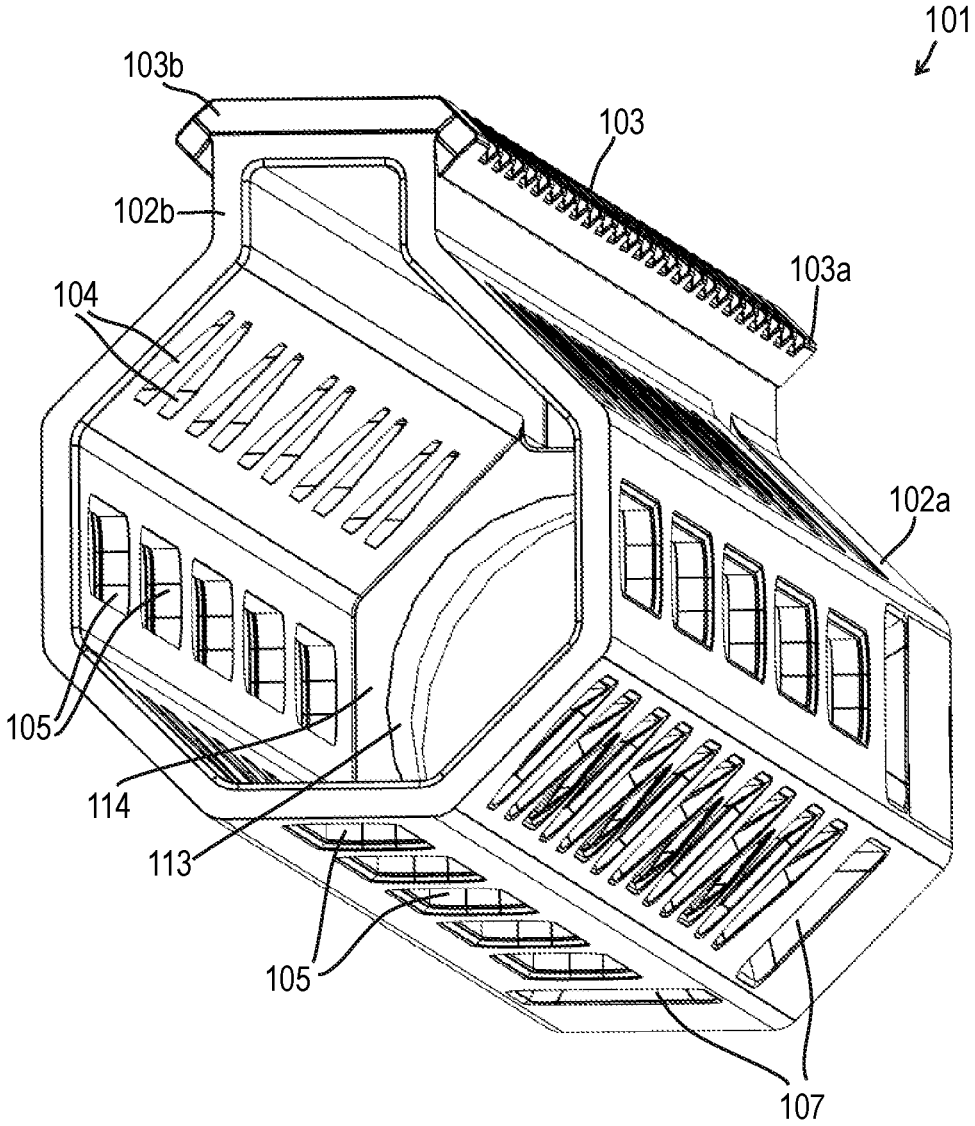
FIG. 4C is a front perspective view of the outer member of FIG. 4A.
Figure 7A:
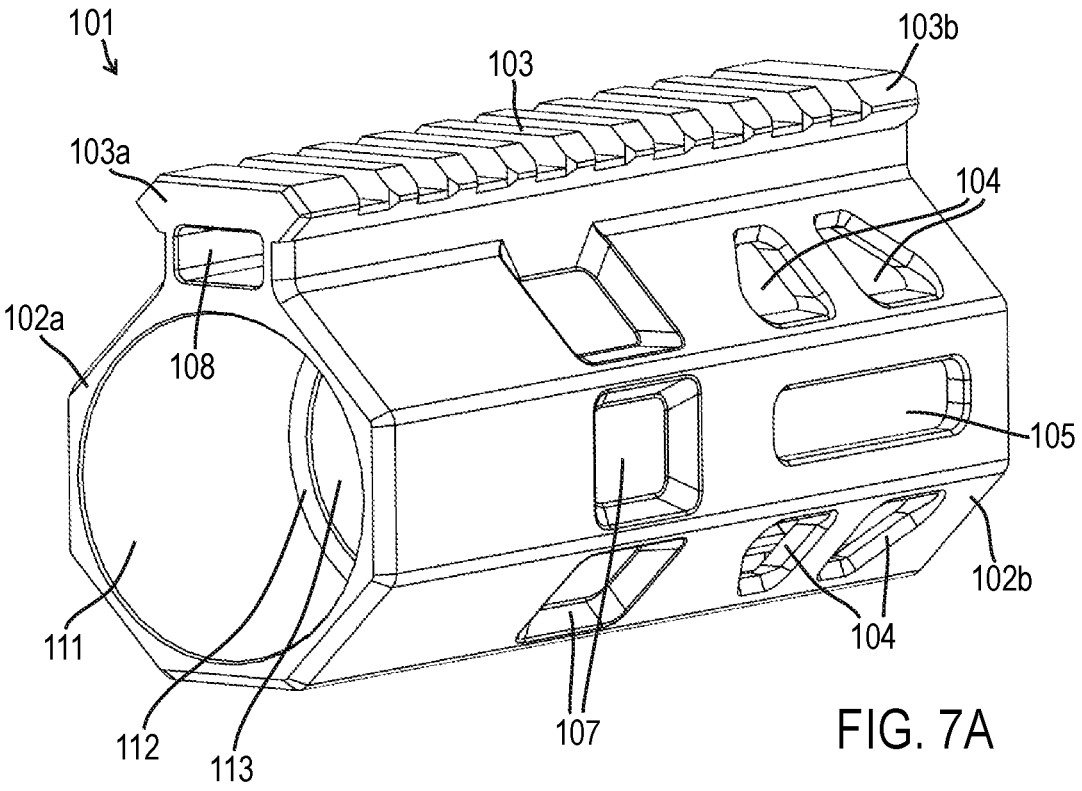
FIG. 7A is a right rear perspective view of an outer member of the handguard assembly of FIG. 1.
Figure 7B:
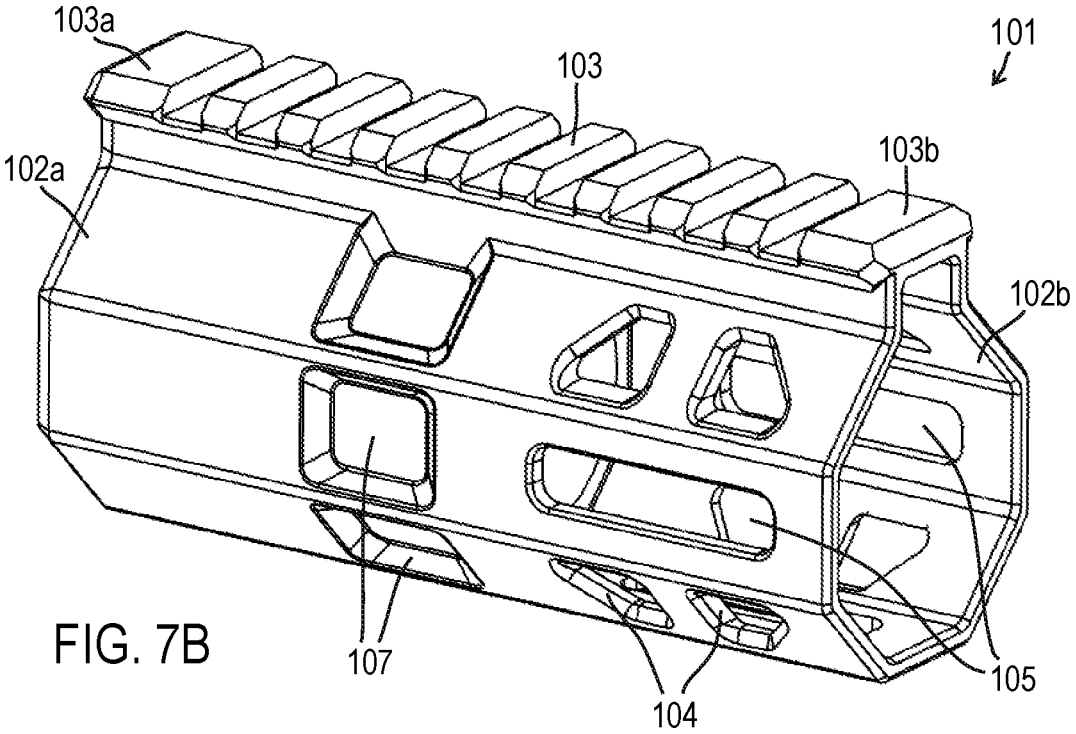
FIG. 7B is a left front perspective view of the outer member of FIG. 7A.

In some cases, a handguard assembly 100 includes an outer member 101, a barrel nut 201, and a forward nut 301 (see FIGS. 1-3). The outer member 101 may include an aft end 102*a*, a forward end 102*b*, an upper rail 103, and an array of openings 104-107. The upper rail 103 may include an aft end 103*a* and a forward end 103*b*. The upper rail 103 may be a Picatinny rail (MIL-STD-1913 rail or STANAG 2324 rail), a Weaver rail, or any other appropriate rail. In some embodiments, the aft end 102*a* of the outer member 101 may be designed to interface with the barrel nut 201. In particular, as shown in FIGS. 1-4A, the aft end 102*a* may include a cavity 111 adjacent to an internal rib 113. As shown in FIGS. 4A, 4C, and 7A, the internal rib 113 may include a rear face 112 and a forward face 114.

The outer member 101 may be configured as a free float handguard and may be available in various lengths (based on operator preference, barrel length, and/or any other appropriate factor). For example, as shown in FIGS. 1-4C, the outer member 101 may have an intermediate length while the example of the outer member 101 shown in FIGS. 7A and 7B may have a shorter length. In some cases, the outer member 101 may be approximately 10"-11" (254 mm-280 mm). In other cases, the outer member 101 may be approximately 5"-6" (127 mm-153 mm). In some embodiments, the outer member 101 may be approximately 13"-15" (330 mm-381 mm). In other embodiments, the outer member 101 may be approximately 8"-9" (203 mm-229 mm). In some cases, the forward end 102*b* may be designed to extend approximately to the end of the barrel where the barrel can be any length from approximately 1"-24" (25.4 mm-609.6 mm) or any other appropriate length. In some cases, the outer member 101 is configured such that the forward end 102*b* is located before an end of the barrel such that the barrel extends beyond the outer member 101 and a portion of the barrel is exposed. In other cases, the outer member 101 is configured such that the forward end 102*b* is beyond an end of the barrel such that the barrel and at least a portion of a muzzle device (muzzle brake, compensator, flash hider, suppressor, etc.) is covered by (i.e., located within) the outer member 101.

In some embodiments, the cross-section of the outer member 101 is approximately polygonal. For example, the outer member 101 may be approximately hexagonal or octagonal where the side oriented at the top of the outer member 101 is offset in the vertical direction to form the upper rail 103. In addition to hexagonal or octagonal, the cross-section of the outer member 101 may be any shape including circular, square, rectangular, pentagonal, heptagonal, nonagonal, decagonal, or any other appropriate shape.

Figure 10:
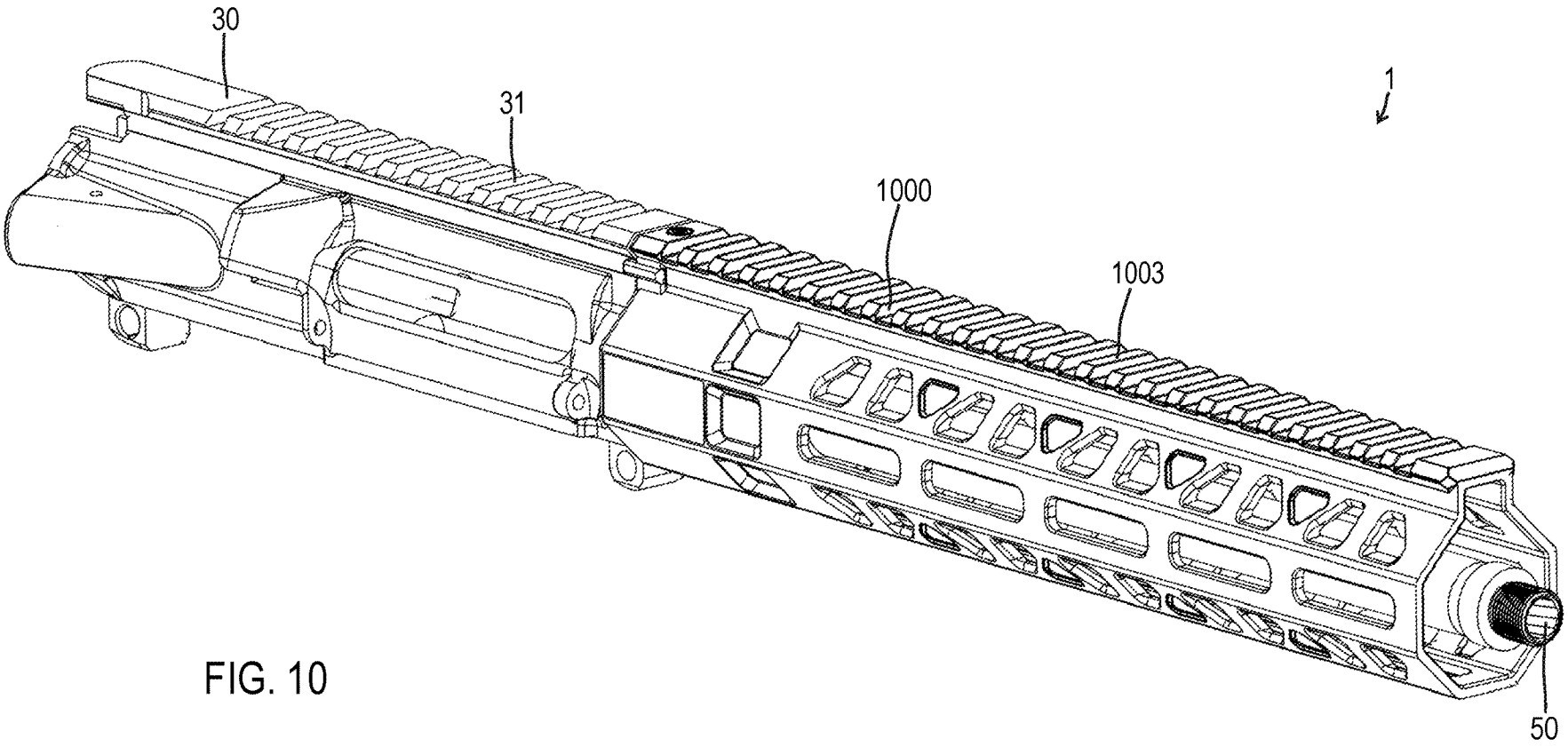
FIG. 10 is a front perspective view of a firearm according to certain embodiments of the present invention.
Figure 11:
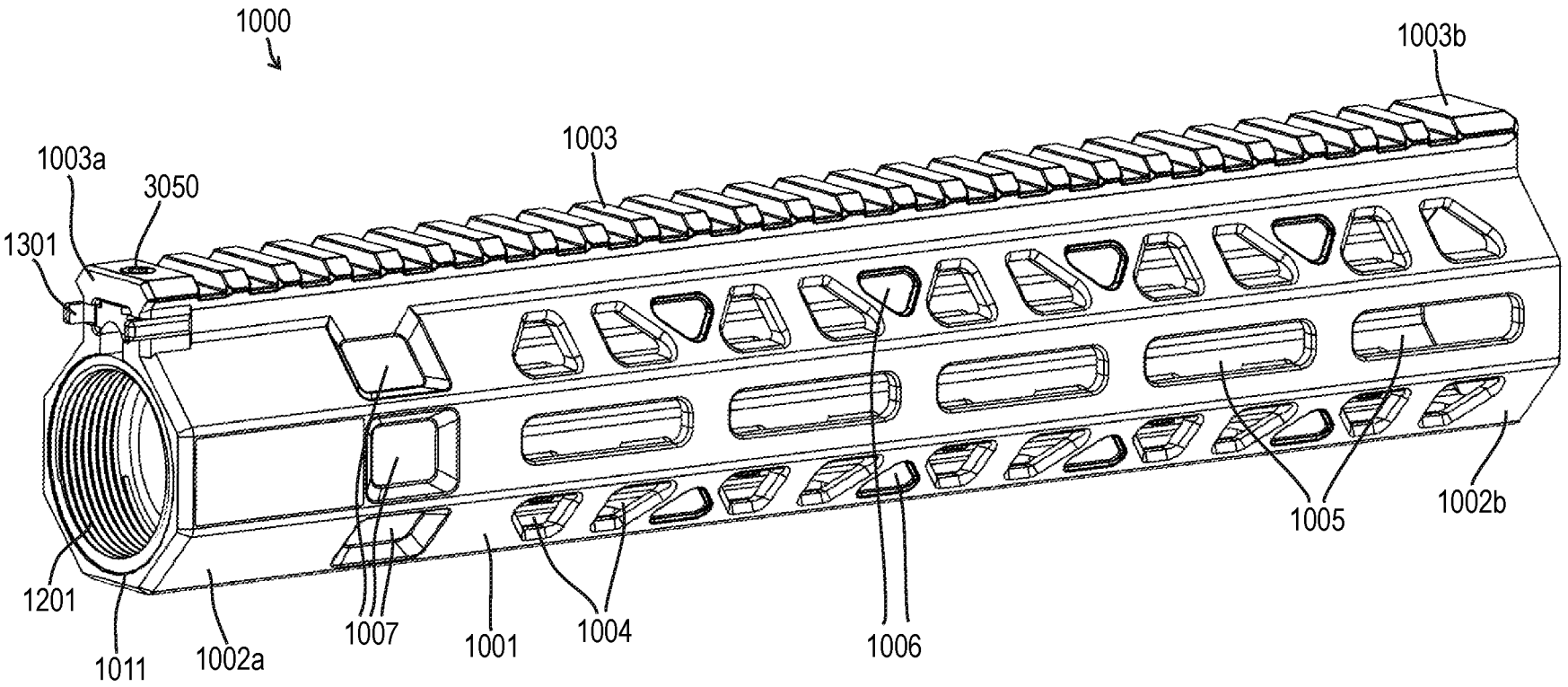
FIG. 11 is a right rear perspective view of a handguard assembly of the firearm of FIG. 10.
Figure 12:
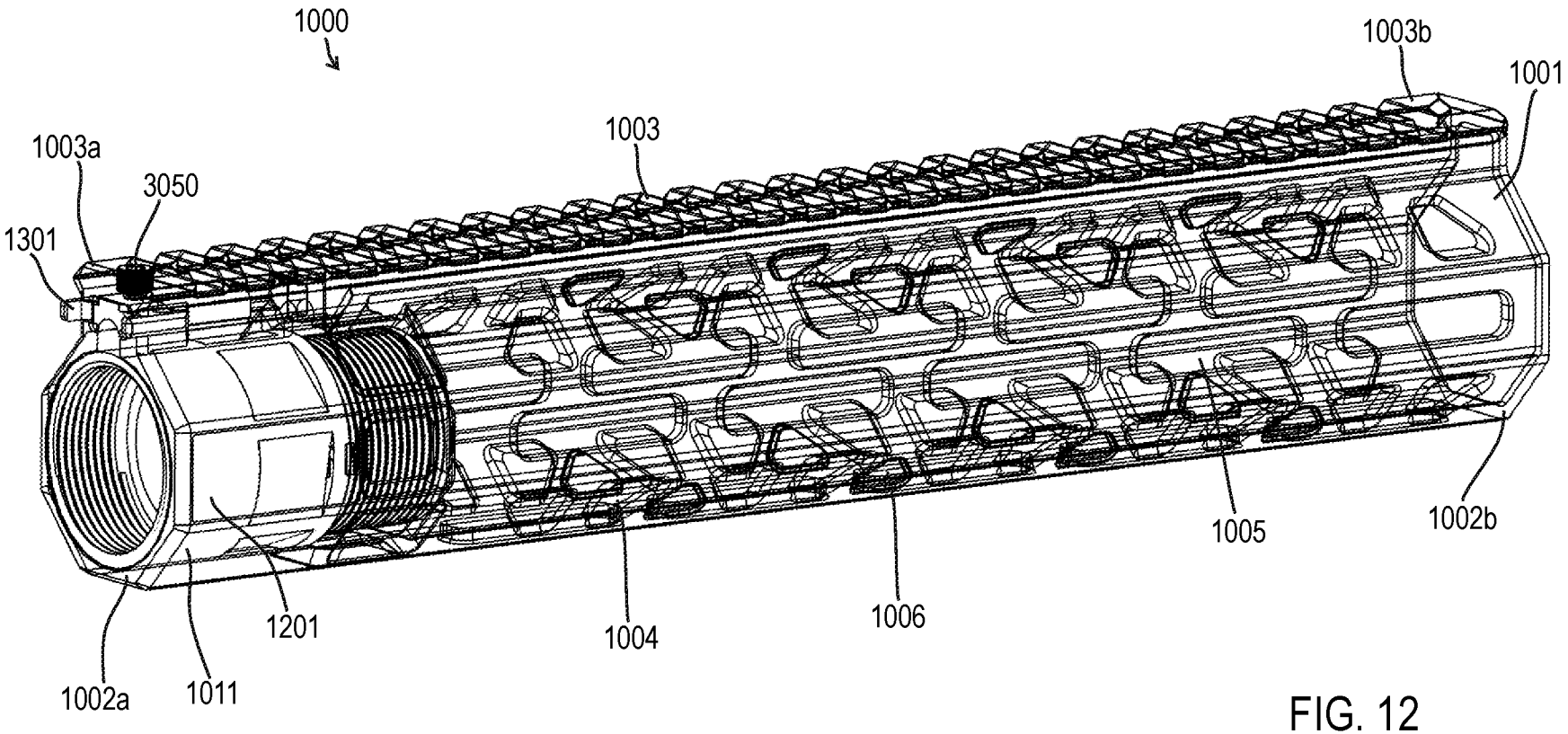
FIG. 12 is a right rear perspective view of the handguard assembly of FIG. 11.
Figure 13:
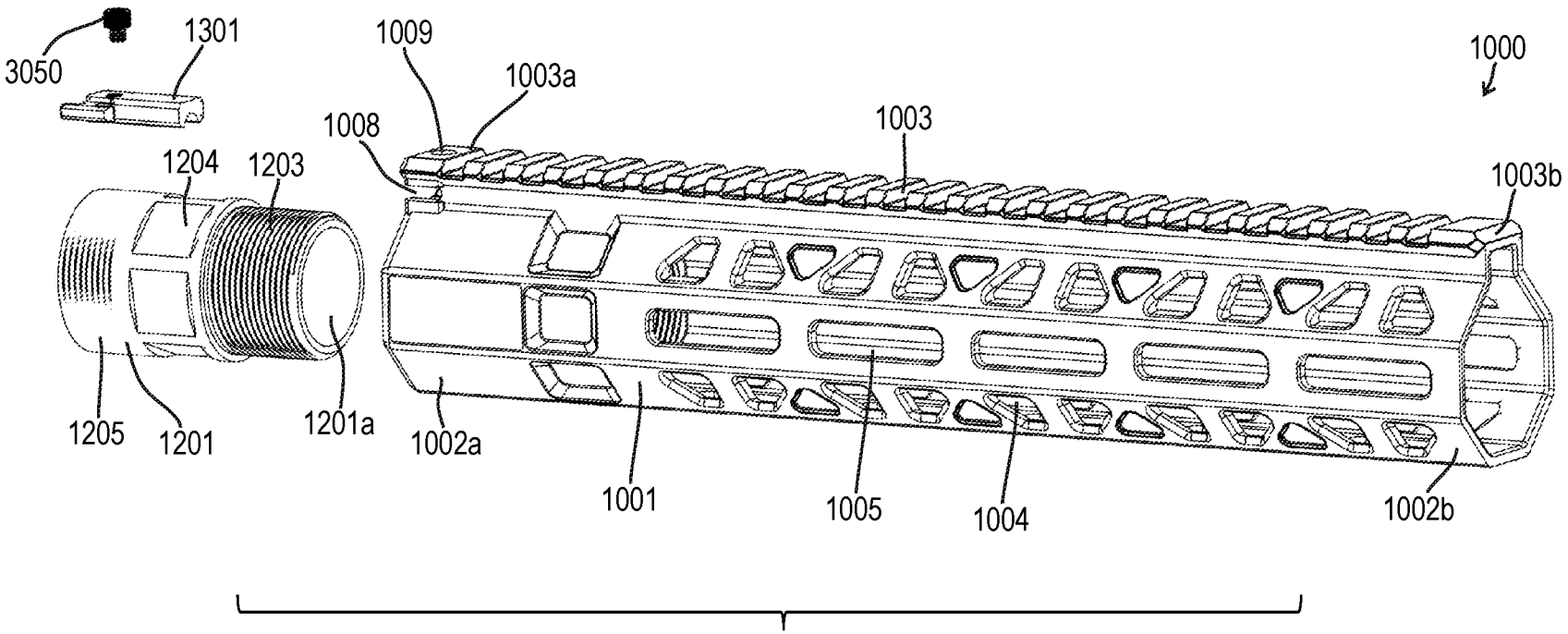
FIG. 13 is an exploded perspective view of the handguard assembly of FIG. 11.

Although other components are not illustrated, it should be understood that the handguard assembly 100 may be arranged adjacent to an upper receiver of a firearm such that the upper rail 103 forms a continuous rail with that of the upper receiver (e.g., see upper receiver 30 of firearm 1 in FIG. 10). In some cases, the handguard assembly 100 may be mounted such that the aft end 103*a* of the upper rail 103 is immediately adjacent to and/or in contact with the forward end of the rail of the upper receiver.

As shown in FIGS. 1-4C, the outer member 101 may include a plurality of openings 104-107. The openings 104-107 may enhance an operator's grip, provide a path for convective air cooling, improve aesthetic appearance, and/or provide various other benefits. The examples of the outer member 101 shown in FIGS. 1-4C include four types of openings 104-107 while the examples of the outer member 101 shown in FIGS. 7A and 7B include three types of openings 104, 105, and 107. However, it should be understood that the outer member 101 may include any number of types of openings including shape, size, quantity, configuration, depth, and/or any other characteristic. The outer member 101 may also include a rear upper cavity 108 (e.g., see FIGS. 1, 2, 4A, and 7A). The rear upper cavity 108 may provide clearance for an adjacent component in the firearm including, for example, a component of a gas or piston system, a gas tube, a piston, or any other appropriate component.

In some embodiments, the openings 104 may have a polygonal shape and extend through a full wall thickness of the outer member 101 (see FIGS. 1-4C, 7A, and 7B). Each corner of the polygon may include a radius or fillet. The shape for each of the openings 104 may be a quadrilateral. In some cases, the shape for each of the openings 104 may be a trapezoid. As shown in the figures, the shape for each of the openings 104 may be a right trapezoid. In some embodiments, each opening 104 may be aligned with a corresponding opening 104 on the opposite side of the outer member 101. For example, an opening 104 on the upper left side of the outer member 101 may be aligned with a corresponding opening 104 on the upper right side of the outer member 101. In some cases, the inner surfaces or flanges of each opening 104 extends in a horizontal direction (i.e., not perpendicular to the local surface of the outer member 101). In addition, the openings 104 may be configured to interface with standardized rail system components such as those for Modular Lock (M-LOK), KeyMod, and/or any other mounting or rail system. The openings 105 may be included to reduce the overall weight of the outer member 101, to reduce the volume of material needed to make the outer member 101, for recesses to engage with the operator's fingers, to improve aesthetics, and/or any other appropriate purpose.

As shown in FIGS. 1-4C, 7A, and 7B, the openings 105 may have a polygonal shape and extend through a full wall thickness of the outer member 101. Each corner of the polygon may include a radius or fillet. The shape for each of the openings 105 may be a quadrilateral. In some cases, the shape for each of the openings 105 may be a rectangle. In some embodiments, each opening 105 may be aligned with a corresponding opening 105 on the opposite side of the outer member 101. For example, an opening 105 on the left side of the outer member 101 may be aligned with a corresponding opening 105 on the right side of the outer member 101. As shown in FIG. 4C, the outer member 101 may include at least one opening 105 on the lowermost surface that does not include a corresponding opening 105 on the opposite side (i.e., the top surface). In addition, the openings 105 may be configured to interface with standardized rail system components such as those for Modular Lock (M-LOK), KeyMod, and/or any other mounting or rail system. The openings 105 may be included to reduce the overall weight of the outer member 101, to reduce the volume of material needed to make the outer member 101, for recesses to engage with the operator's fingers, to improve aesthetics, and/or any other appropriate purpose.

As shown in FIGS. 1-4C, 7A, and 7B, the openings 106 may have a polygonal shape and extend through less than a full wall thickness of the outer member 101. Each corner of the polygon may include a radius or fillet. The shape for each of the openings 106 may be a triangle. In some cases, the shape for each of the openings 106 may be an isosceles triangle. In some embodiments, each opening 106 may be aligned with a corresponding opening 106 on the opposite side of the outer member 101. For example, an opening 106 on the upper left side of the outer member 101 may be aligned with a corresponding opening 106 on the upper right side of the outer member 101. The openings 106 may be included to reduce the localized thickness of the outer member 101, to reduce the overall weight of the outer member 101, to reduce the volume of material needed to make the outer member 101, for recesses to engage with the operator's fingers, to improve aesthetics, and/or any other appropriate purpose. In some embodiments, the openings 106 may be filled (or partially filled) with a secondary material such as polymer, rubber, synthetic rubber, thermoplastic polyurethane, thermoplastic elastomer, thermoplastic rubber, and/or any other appropriate material. The purpose of the secondary material may be to improve grip, tactile interface, ergonomics, aesthetics, and/or any other appropriate quality.

As shown in FIGS. 1-4C, 7A, and 7B, the openings 107 may have a polygonal shape and extend through less than a full wall thickness of the outer member 101. Each corner of the polygon may include a radius or fillet. The shape for each of the openings 107 may be a quadrilateral. In some cases, the shape for each of the openings 107 may be a rectangle. In some embodiments, each opening 107 may be aligned with a corresponding opening 107 on the opposite side of the outer member 101. For example, an opening 107 on the left side of the outer member 101 may be aligned with a corresponding opening 107 on the right side of the outer member 101. As shown in FIG. 4C, the outer member 101 may include at least one opening 107 on the lowermost surface that does not include a corresponding opening 107 on the opposite side (i.e., the top surface). The openings 107 may be included to reduce the localized thickness of the outer member 101, to reduce the overall weight of the outer member 101, to reduce the volume of material needed to make the outer member 101, for recesses to engage with the operator's fingers, to improve aesthetics, and/or any other appropriate purpose. In some embodiments, the openings 107 may be filled (or partially filled) with a secondary material such as polymer, rubber, synthetic rubber, thermoplastic polyurethane, thermoplastic elastomer, thermoplastic rubber, and/or any other appropriate material. The purpose of the secondary material may be to improve grip, tactile interface, ergonomics, aesthetics, and/or any other appropriate quality. In some embodiments, the openings 107 are aligned with the internal rib 113 of the outer member 101, which reduces the overall thickness of the outer member 101 in this area.

To secure the components to one another, in some embodiments, after the barrel is inserted into the upper receiver, the barrel nut 201 is threaded onto the upper receiver such that aft threaded portion 202 engages the upper receiver and the barrel extends through the central bore 201*a* of the barrel nut 201 (a similar arrangement is shown in FIG. 10). The barrel nut 201 may include a plurality of flat portions 204 to allow a wrench to engage and tighten the barrel nut 201. The outer member 101 is then inserted (such that the barrel extends into the center of the outer member 101) until at least one spike portion 205 of the barrel nut 201 contact the rear face 112 of the internal rib 113 of the outer member 101. The forward nut 301 is then inserted into the forward end 102*b* of the outer member 101 (such that the barrel extends through the central bore 304 of the forward nut 301) and threaded onto the forward threaded portion 203 of the barrel nut 201 until the aft face 302 of the forward nut 301 contacts the forward face 114 of the outer member 101.

Subsequent tightening of the forward nut 301 causes the at least one spike portion 205 to penetrate into the rear face 112 of the internal rib 113 of the outer member 101, which locks the components together. In some embodiments, it may be necessary to hammer or tap the outer member 101 and the barrel nut 201 together before tightening the forward nut 301. During the installation of the outer member 101, an alignment tool may be used which engages the aft end 103*a* of the upper rail 103 along with a forward portion of the rail of the upper receiver. This alignment tool ensures that the outer member 101 is installed such that the upper rail 103 and the rail of the upper receiver are aligned.

Figure 5A:
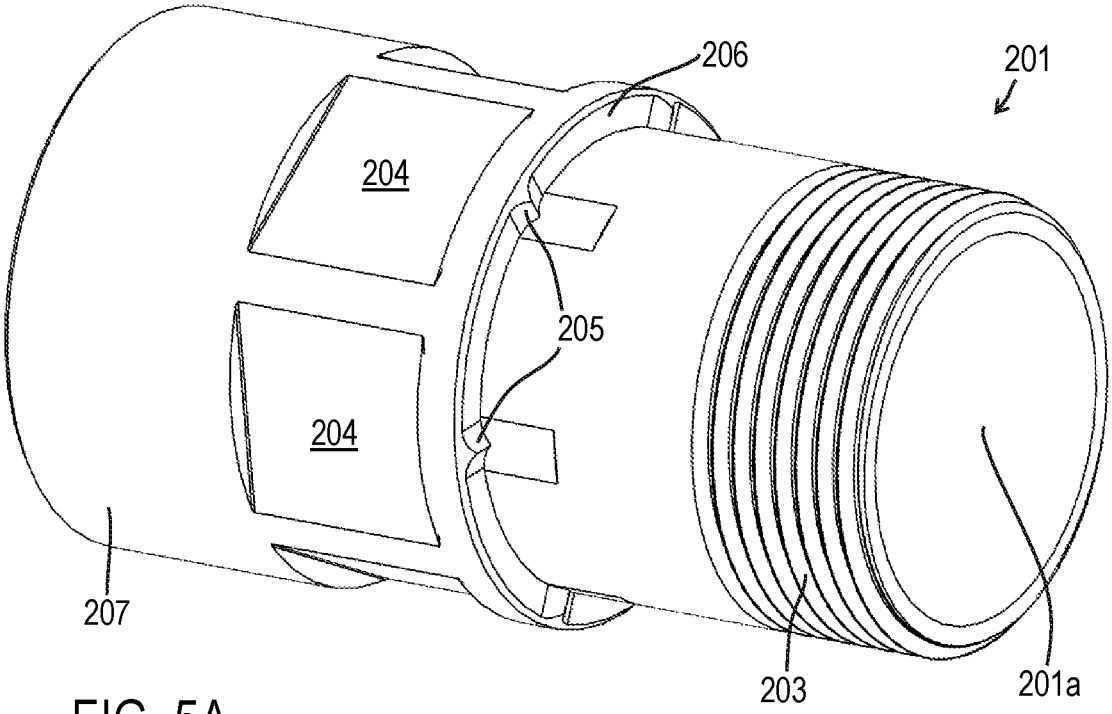
FIG. 5A is a front perspective view of a barrel nut of the handguard assembly of FIG. 1.
Figure 5B:
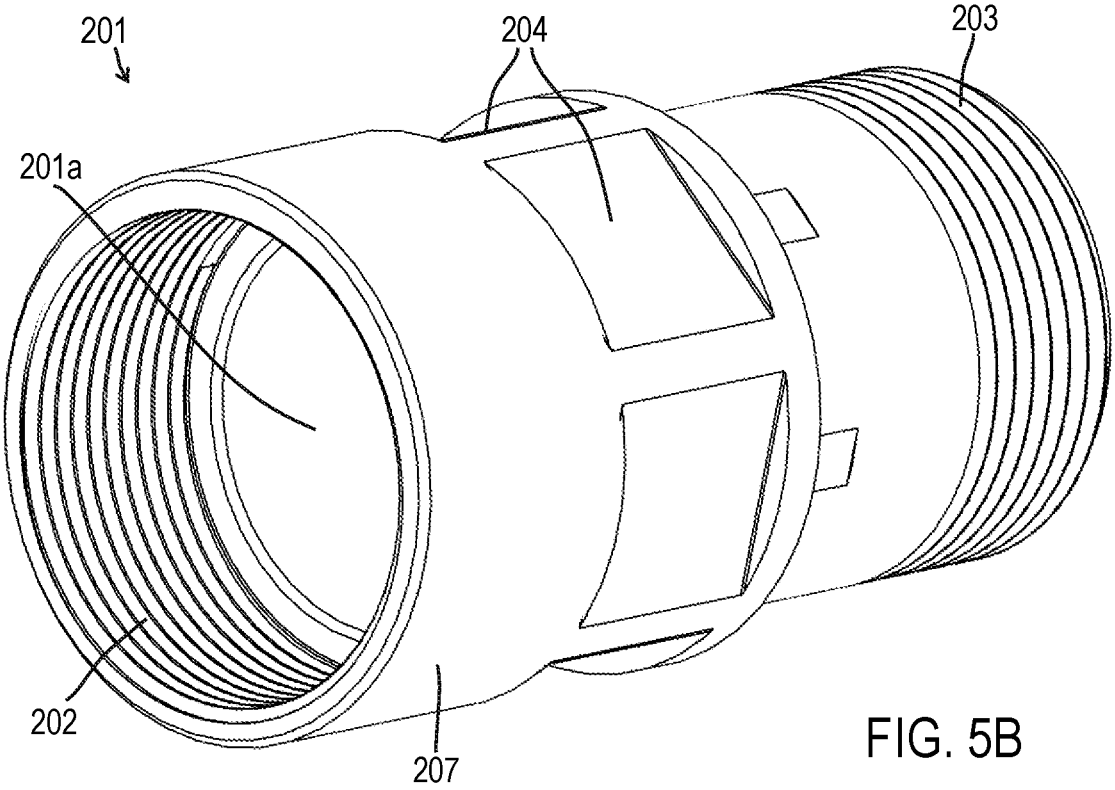
FIG. 5B is a rear perspective view of the barrel nut of FIG. 5A.
Figure 5C:
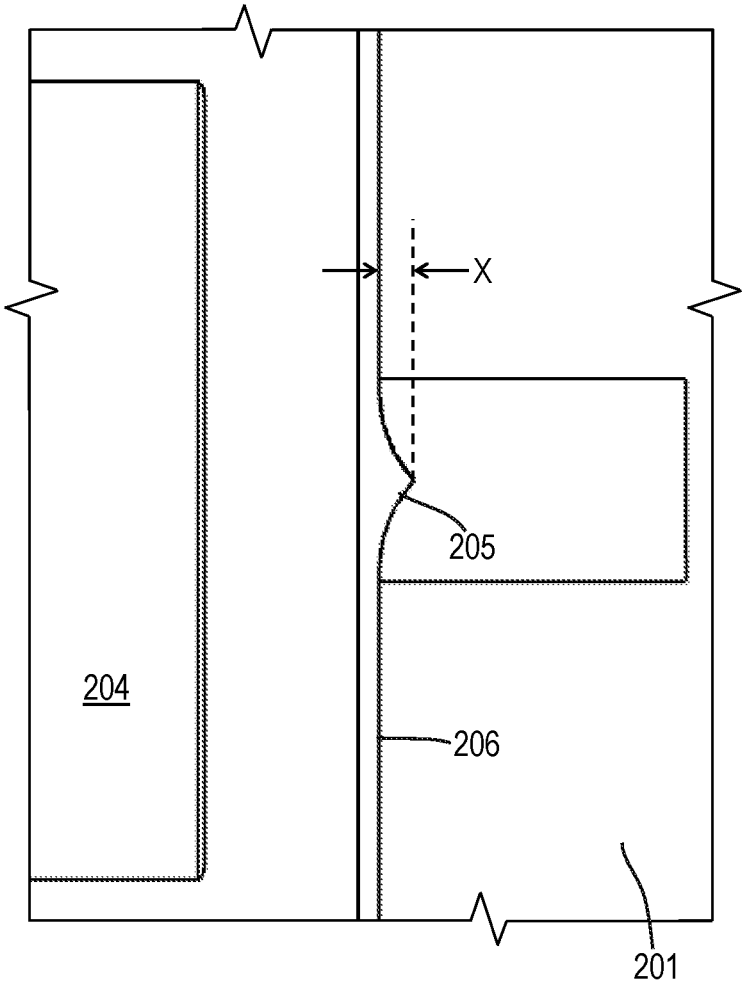
FIG. 5C is a side detail partial view of the barrel nut of FIG. 5A.
Figure 6A:
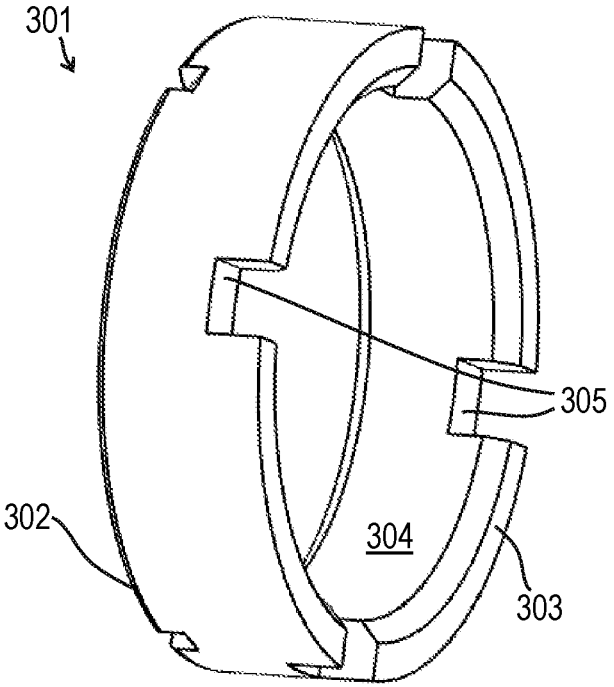
FIG. 6A is a front perspective view of a forward extension nut of the handguard assembly of FIG. 1.
Figure 6B:
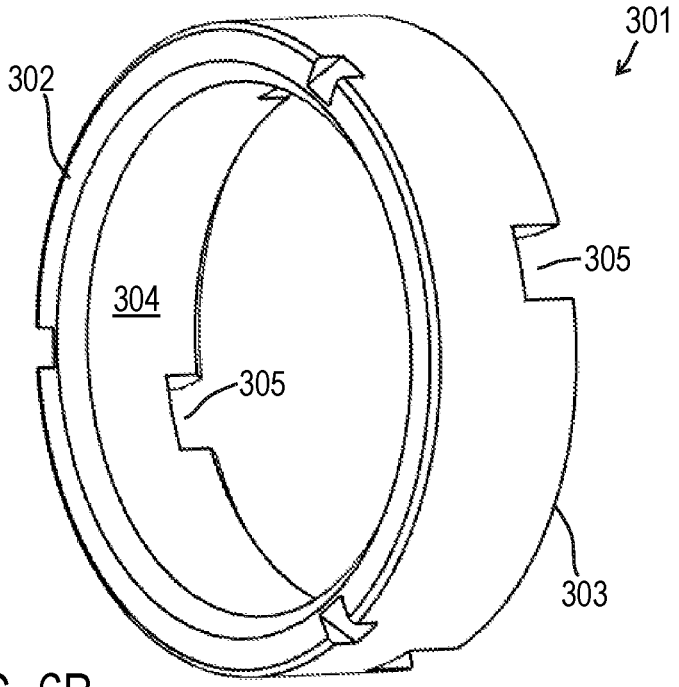
FIG. 6B is a right perspective view of the forward extension nut of FIG. 6A.

As shown in FIG. 5A, the barrel nut 201 may be configured with six spike portions 205 that extend from surface 206 that are configured to engage the outer member 101. It should be understood that the configuration of the spike portion(s) 205 will vary based on the material of the barrel nut 201, the material of the outer member 101, and/or various other factors. It should also be noted that the configuration of the spike portion(s) 205 includes the quantity and individual geometry of each spike portion 205, among other factors. The barrel nut 201 may include as few as one spike portion 205 or as many as 8, 10, 12, 16, 32, 64, or any appropriate number of spike portion(s) 205. Although the spike portion(s) 205 are illustrated as integral feature(s) of the barrel nut 201; however, the spike portion(s) 205 may included as a separate component (e.g., a ring or a washer) that can be positioned or clocked relative to the barrel nut 201. As shown in FIG. 5C, each spike portion 205 may extend a distance X from surface 206. In some embodiments, the distance X is approximately 0.01"-0.04" (0.254 mm-1.016 mm). In some cases, the distance X is approximately 0.015"-0.035" (0.381 mm-0.889 mm). In some embodiments, the distance X is approximately 0.02"-0.03" (0.508 mm-0.762 mm). In some cases, the distance X is approximately 0.025" (0.635 mm). In some embodiments, the distance X is approximately 0.005" (0.127 mm).

In some embodiments, the barrel nut 201 is configured such that the outer surface 207 engages or locks with the cavity 111 of the outer member 101. The outer surface 207 may include one or more mechanical features for engaging the rear cavity 111. For example, the outer surface 207 may include knurling, one or more protrusions, or other relevant features for engaging and preventing rotation of the outer member 101. In some cases, in addition to or in lieu of the mechanical features described above, the outer surface 207 may include a taper such that the aft-most portion of the outer surface 207 has a larger dimension than other portions of the outer surface 207. For example, for embodiments where the outer surface 207 is cylindrical, the aft end of the outer surface 207 may have a larger diameter than other portions of the outer surface 207. Accordingly, when the outer member 101 and the barrel nut 201 are fully engaged with one another, the larger dimension at the aft end of the outer surface 207 creates radial pressure onto the aft end 102*a* of the outer member 101.

Figure 8A:
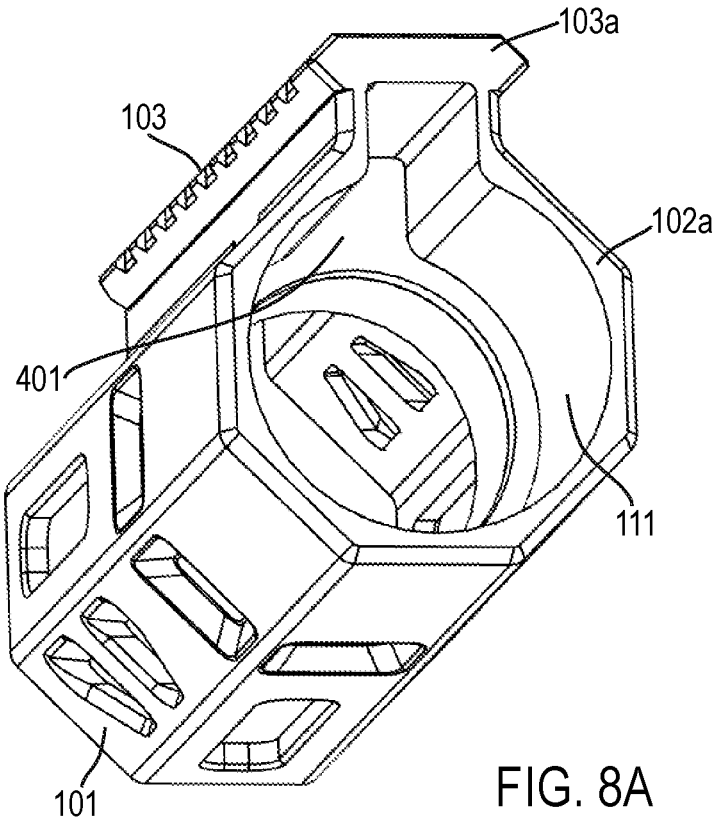
FIG. 8A is a left rear perspective view of an outer member of the handguard assembly of FIG. 1.
Figure 8B:
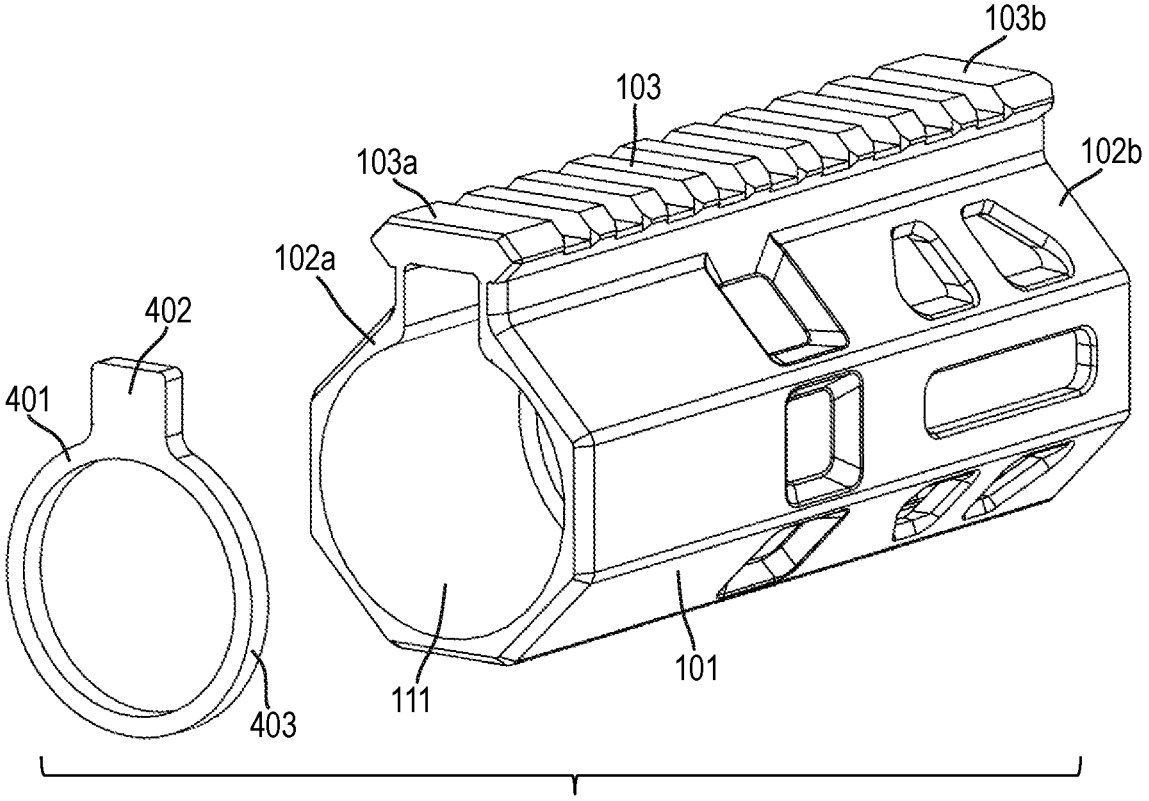
FIG. 8B is a right rear exploded perspective view of the outer member of FIG. 8A.
Figure 9:
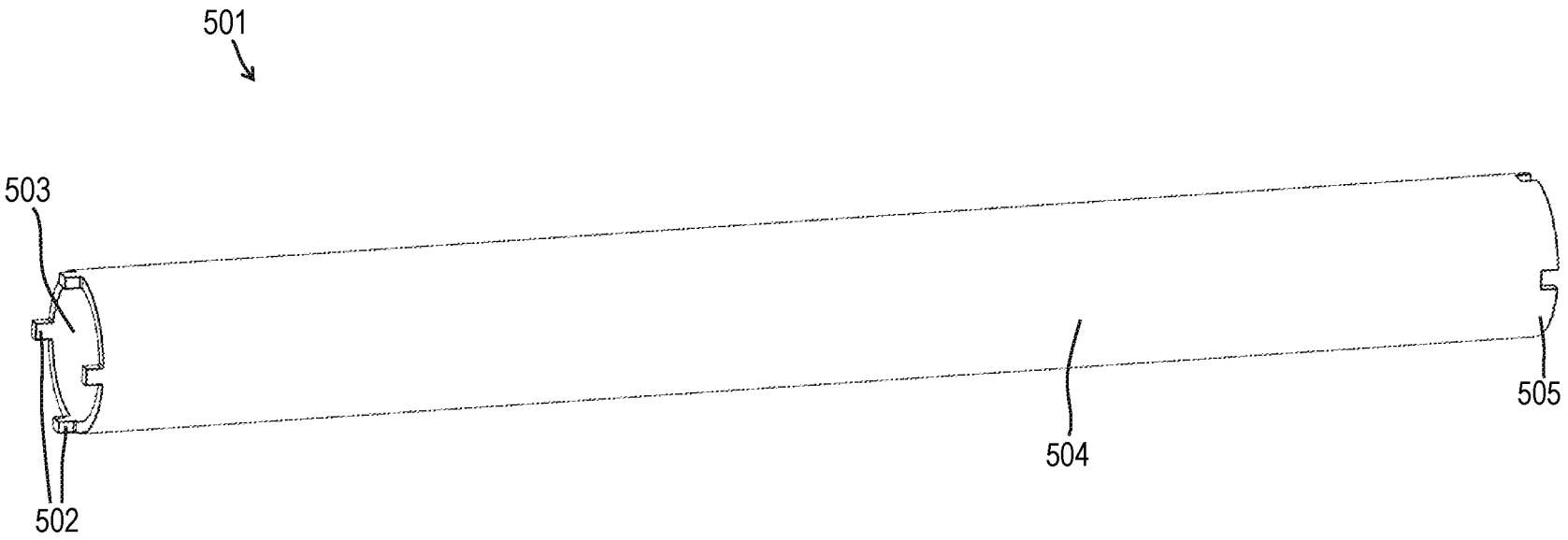
FIG. 9 is a perspective view of an installation tool for the handguard assembly of FIG. 1.

As shown in FIGS. 8A and 8B, in some cases, the outer member 101 may include a rear ring 401 disposed within the cavity 111. The rear ring 401 may be a separate component and may include an upper portion 402 that engages the open area within the outer member 101 adjacent to the upper rail 103. The interface of the upper portion 402 with cavity 111 may be one option for preventing the rear ring 401 from rotating relative to the outer member 101. In addition to or in lieu of the upper portion 402, the rear ring 401 may include other features to prevent rotation relative to the outer member 101 after installation. For example, the internal shape of the cavity 111 may be polygonal (e.g., hexagonal, octagonal, etc.) and the rear ring 401 may include a corresponding shape to engage this polygonal shape. In some embodiments, the outer surface 403 (which interfaces with the cavity 111) may have a series of protrusions that engage corresponding recesses in the cavity 111. In some embodiments where the upper portion 402 is not included, this set of corresponding protrusions and recesses may allow the rear ring 401 to be clocked or indexed into multiple positions which would allow the rear ring 401 to be installed multiple times (i.e., so the spike portion(s) 205 can engage different orientations). When assembled, the rear ring 401 may be sandwiched between the internal rib 113 and the barrel nut 201 such that the spike portion(s) 205 are pressed into the rear ring 401. In some embodiments, the rear ring 401 is a softer and/or more compliant material better suited to engage with the spike portion(s) 205 (compared to the outer member 101). For example, if the outer member 101 is an aluminum alloy, the rear ring 401 may be a polymer material. In some cases, the outer member 101 is a polymer, the rear ring 401 may be a different softer polymer material. The rear ring 401 may be a consumable item that can be replaced whenever the barrel nut 201 needs to be removed from the upper receiver.

In some embodiments, the barrel nut 201 is made from steel alloy, titanium, aluminum alloy, and/or any other appropriate material. In other embodiments, the barrel nut 201 is made from a 7000 series aluminum alloy (or a steel alloy) and the outer member 101 is made from a 6000 series aluminum alloy (or a 7000 series aluminum alloy). In some embodiments, the barrel nut 201 is made from 7075 aluminum alloy and the outer member 101 is made from 6061 aluminum alloy. In other embodiments, the outer member 101 is made from a polymer material. In some embodiments, the outer member 101 is a polymer material including, for example, plastic, thermoplastic, nylon, polyetherimide, thermosetting polymer, polyoxymethylene (acetal), polytetrafluoroethylene, polyethylene, polypropylene, polyvinyl chloride, polystyrene, carbon composite, and/or other plastic or polymer materials.

The configuration of the handguard assembly 100 may also lead to more streamlined manufacturing processes compared to conventional handguards. For example, in some embodiments, the barrel nut 201 and the forward nut 301 are the only metallic components while the outer member 101 is a polymer component. In some cases, the outer member 101 is injection molded in a single step. In other words, the most complex portions of the handguard assembly 100 (i.e., the overall shape, the upper rail 103, the openings 104-107, etc.) may be injection molded in a single step. As described above, in some cases, the injection molding process may include a second step where the secondary material is injected into some of the openings (e.g., openings 106 and/or openings 107). Injection molding the outer member 101 significantly reduces overall manufacturing time compared to a conventional fully machined handguard.

In some embodiments, the forward nut 301 is tightened from the forward side of the outer member 101. For example, to tighten the forward nut 301, an installation tool 501 (see FIG. 9) may be inserted through the outer member 101 (such that the barrel extends through the central bore 503 of the installation tool 501). The installation tool 501 is inserted until it is adjacent to the forward face 303 of the forward nut 301 such that the protrusions 502 engage recesses 305. Accordingly, an appropriate tool (e.g., a spanner wrench) can be used to turn the secondary end 505 of the installation tool 501 to rotate the forward nut 301. The forward nut 301 may be a castle nut, a spanner nut, and/or any other appropriate type of nut.

As shown in FIGS. 10-18B, in some cases, a handguard assembly 1000 includes an outer member 1001, a barrel nut 1201, and an alignment member 1301. The outer member 1001 may include an aft end 1002*a*, a forward end 1002*b*, an upper rail 1003, and an array of openings 1004-1007. The upper rail 1003 may include an aft end 1003*a* and a forward end 1003*b*. The upper rail 1003 may be a Picatinny rail (MIL-STD-1913 rail or STANAG 2324 rail), a Weaver rail, or any other appropriate rail. In some embodiments, the aft end 1002*a* of the outer member 1001 may be designed to interface with the barrel nut 1201. In particular, as shown in FIGS. 11, 12, 14A, 14C, 15, 18A, and 18B, the aft end 1002*a* may include a rear cavity 1011 adjacent to an attachment portion 1013. The barrel nut 1201 may at least partially fit within the rear cavity 1011. The attachment portion 1013 may be designed to attach to the barrel nut 1201 in a variety of ways including press-fit, adhesive, overmolding (or co-molding), threaded attachment, and/or any other appropriate type of attachment. In some embodiments, the attachment portion 1013 is a threaded portion 1013. As shown in FIG. 14A, the threaded portion 1013 may include a rear face 1012.

As shown in FIG. 10, the handguard assembly 1000 may be arranged adjacent to an upper receiver 30 of a firearm 1 such that the upper rail 1003 forms a continuous rail with the upper rail 31 of the upper receiver 30. In some cases, the handguard assembly 1000 may be mounted such that the aft end 1003*a* of the upper rail 1003 is immediately adjacent to and/or in contact with the forward end of the upper rail 31 of the upper receiver 30.

The outer member 1001 may be configured as a free float handguard and may be available in various lengths (based on operator preference, barrel length, and/or any other appropriate factor). For example, as shown in the drawings, the outer member 1001 may have an intermediate length. In some cases, the outer member 1001 may be approximately 10"-11" (254 mm-280 mm). In other cases, the outer member 1001 may be approximately 5"-6" (127 mm-153 mm). In some embodiments, the outer member 1001 may be approximately 13"-15" (330 mm-381 mm). In other embodiments, the outer member 1001 may be approximately 8"-9"(203 mm-229 mm). In some cases, the forward end 1002*b* may be designed to extend approximately to the end of the barrel 50 where the barrel 50 can be any length from approximately 1"-24" (25.4 mm-609.6 mm) or any other appropriate length. In some cases, the outer member 1001 is configured such that the forward end 1002*b* is located before an end of the barrel 50 such that the barrel 50 extends beyond the outer member 1001 and a portion of the barrel 50 is exposed. In other cases, the outer member 1001 is configured such that the forward end 1002*b* is beyond an end of the barrel 50 such that the barrel 50 and at least a portion of a muzzle device (muzzle brake, compensator, flash hider, suppressor, etc.) is covered by (i.e., located within) the outer member 1001.

In some embodiments, the cross-section of the outer member 1001 is approximately polygonal. For example, the outer member 1001 may be approximately hexagonal or octagonal where the side oriented at the top of the outer member 1001 is offset in the vertical direction to form the upper rail 1003. In addition to hexagonal or octagonal, the cross-section of the outer member 1001 may be any shape including circular, square, rectangular, pentagonal, heptagonal, nonagonal, decagonal, or any other appropriate shape.

As shown in FIGS. 10-15, the outer member 1001 may include a plurality of openings 1004-1007. The openings 1004-1007 may enhance an operator's grip, provide a path for convective air cooling, improve aesthetic appearance, and/or provide various other benefits. The examples of the outer member 1001 shown in FIGS. 10-15 include four types of openings 1004-1007. However, it should be understood that the outer member 1001 may include any number of types of openings including shape, size, quantity, configuration, depth, and/or any other characteristic.

In some embodiments, the openings 1004 may have a polygonal shape and extend through a full wall thickness of the outer member 1001 (see FIGS. 10-14C). Each corner of the polygon may include a radius or fillet. The shape for each of the openings 1004 may be a quadrilateral. In some cases, the shape for each of the openings 1004 may be a trapezoid. As shown in the figures, the shape for each of the openings 1004 may be a right trapezoid. In some embodiments, each opening 1004 may be aligned with a corresponding opening 1004 on the opposite side of the outer member 1001. For example, an opening 1004 on the upper left side of the outer member 1001 may be aligned with a corresponding opening 1004 on the upper right side of the outer member 1001. In some cases, the inner surfaces or flanges of each opening 1004 extends in a horizontal direction (i.e., not perpendicular to the local surface of the outer member 1001). In addition, the openings 1004 may be configured to interface with standardized rail system components such as those for Modular Lock (M-LOK), KeyMod, and/or any other mounting or rail system. The openings 1005 may be included to reduce the overall weight of the outer member 1001, to reduce the volume of material needed to make the outer member 1001, for recesses to engage with the operator's fingers, to improve aesthetics, and/or any other appropriate purpose.

Figure 14A:
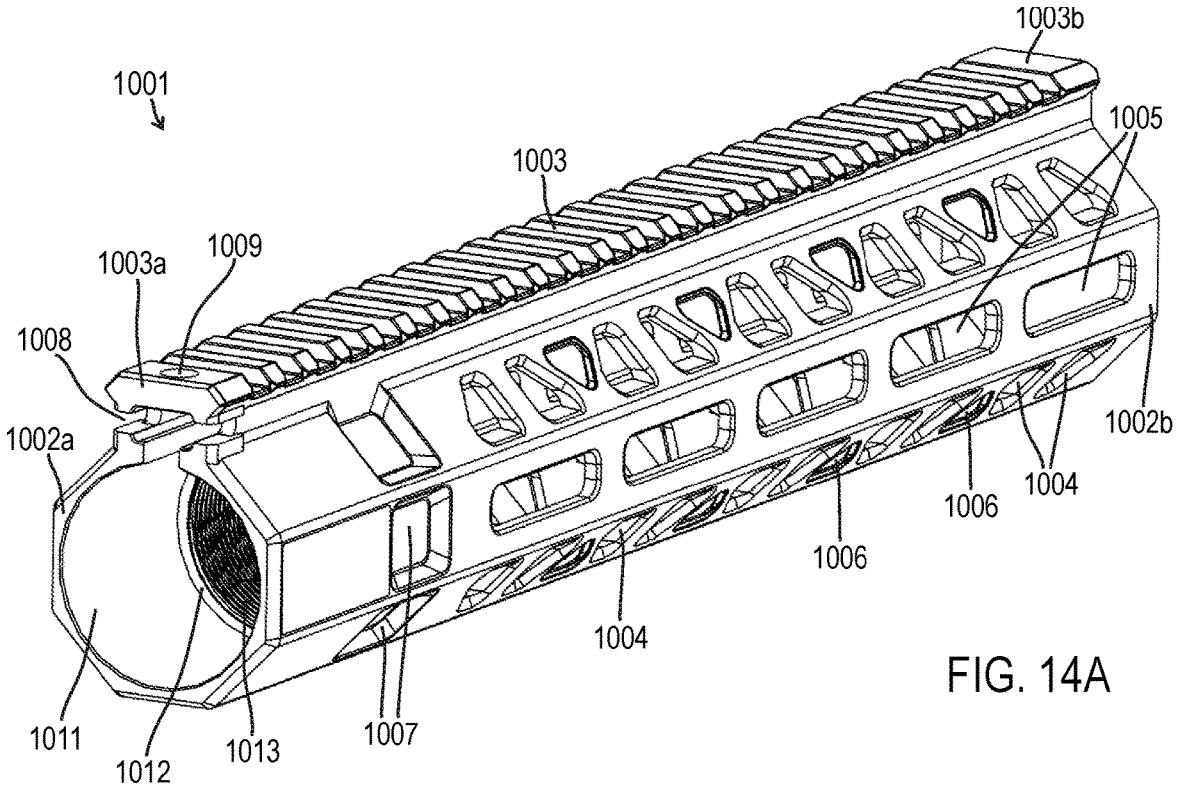
FIG. 14A is a right rear perspective view of an outer member of the handguard assembly of FIG. 11.
Figure 14B:
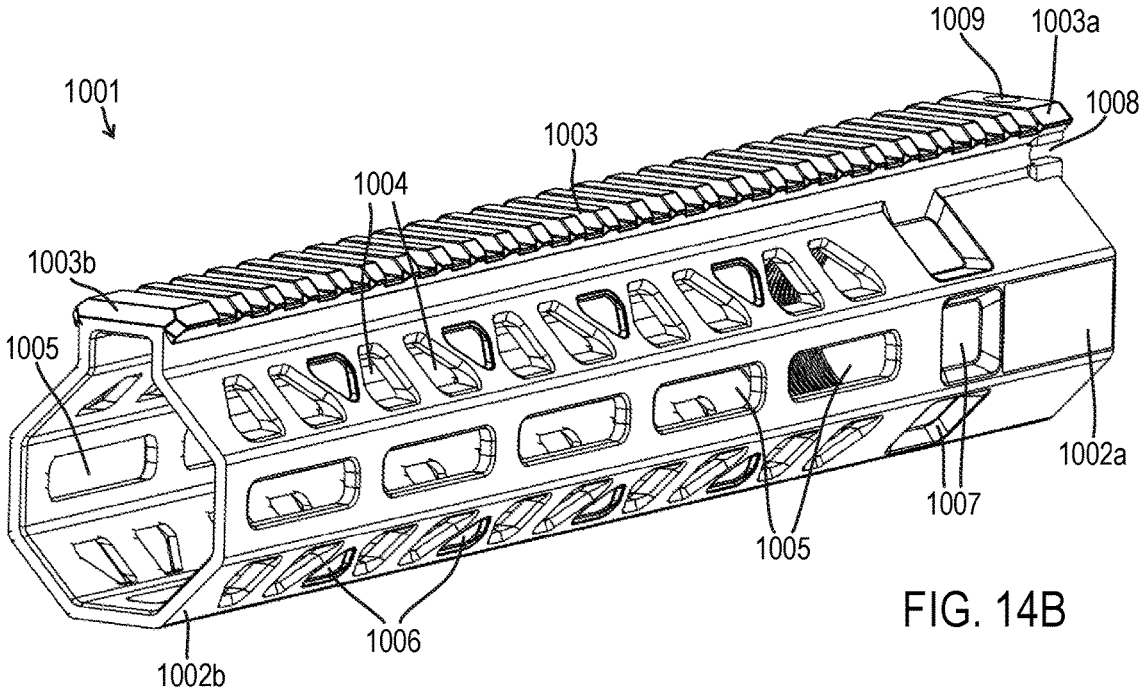
FIG. 14B is a left front perspective view of the outer member of FIG. 14A.
Figure 14C:
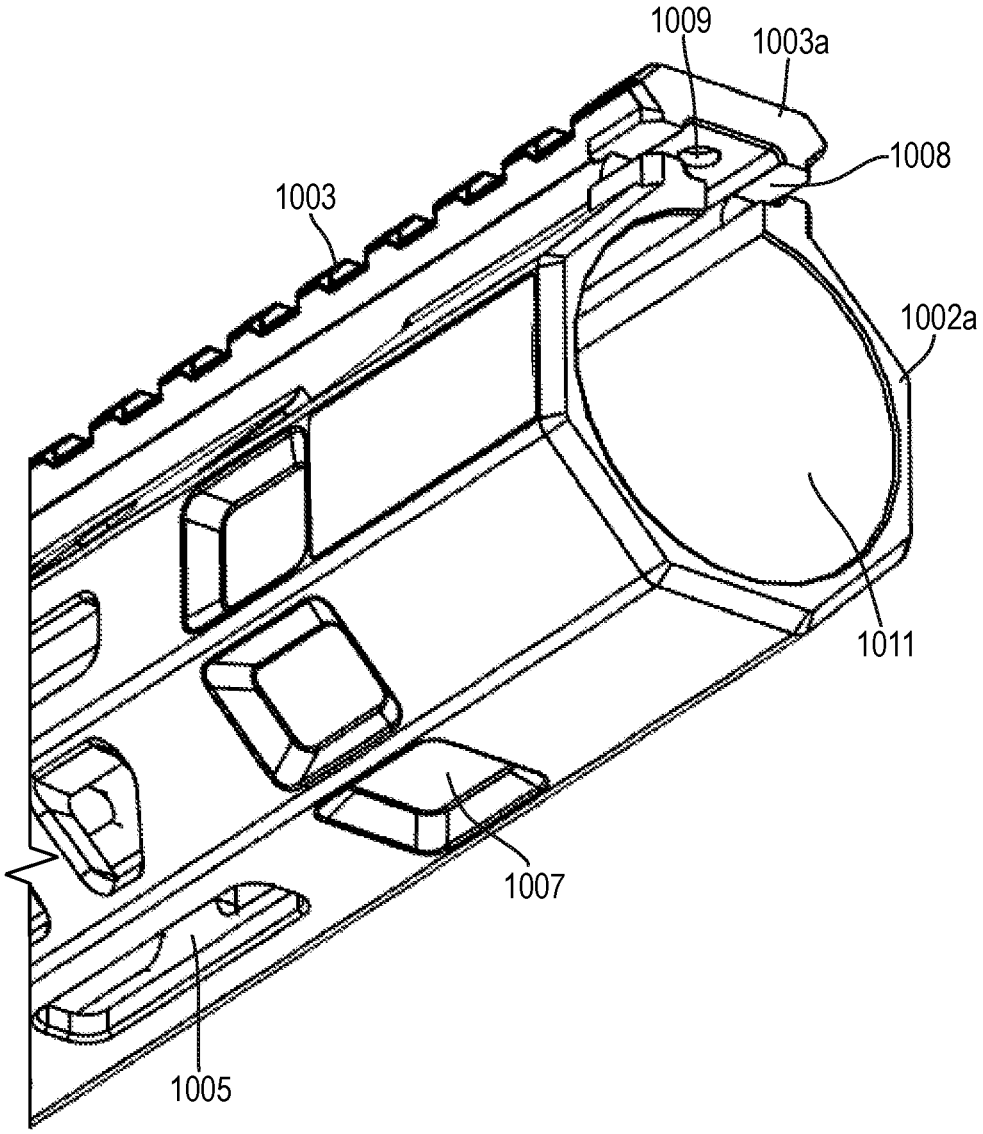
FIG. 14C is a rear partial perspective view of the outer member of FIG. 14A.
Figure 15:
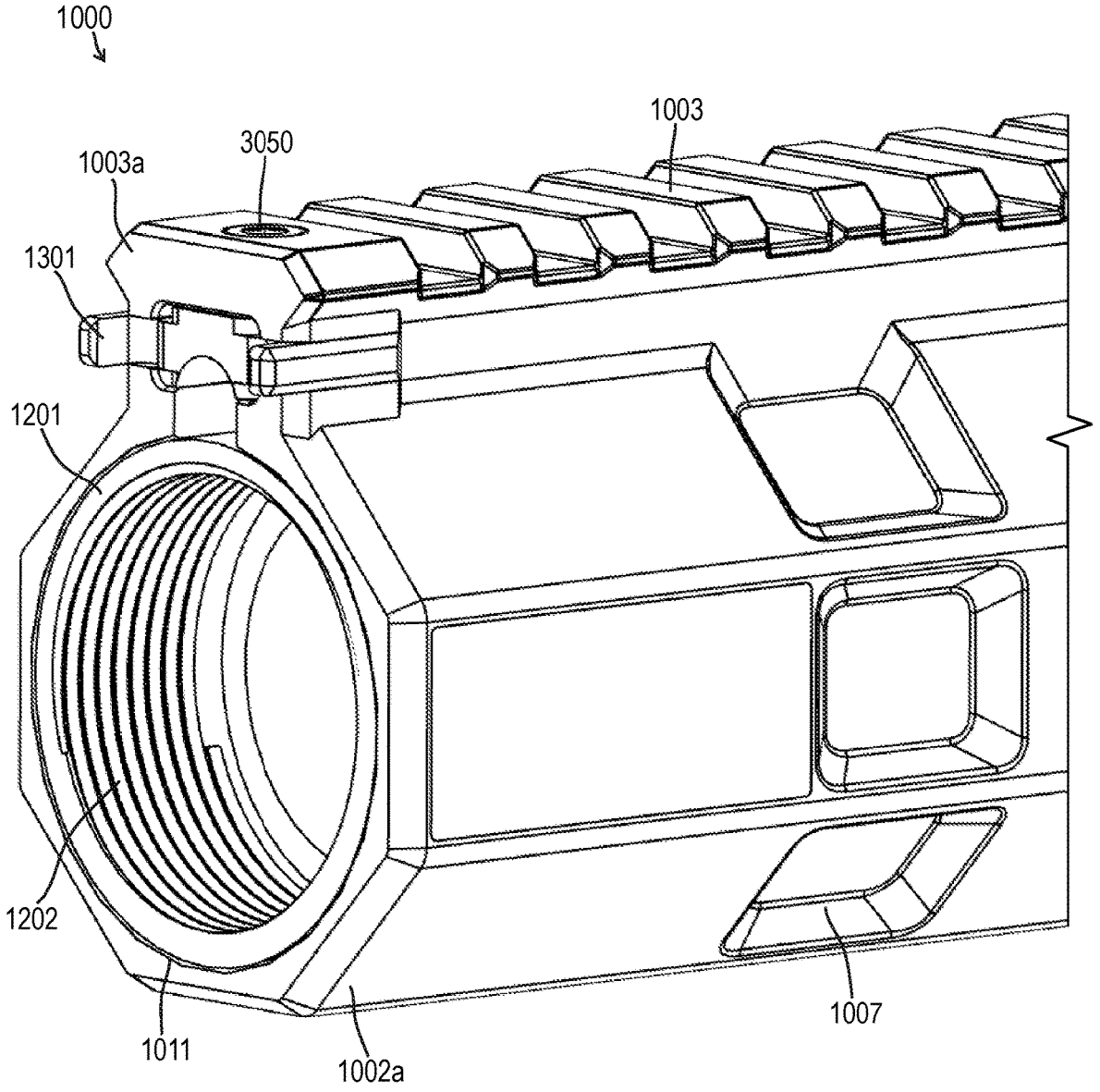
FIG. 15 is a rear partial perspective view of the handguard assembly of FIG. 11.
Figure 16A:
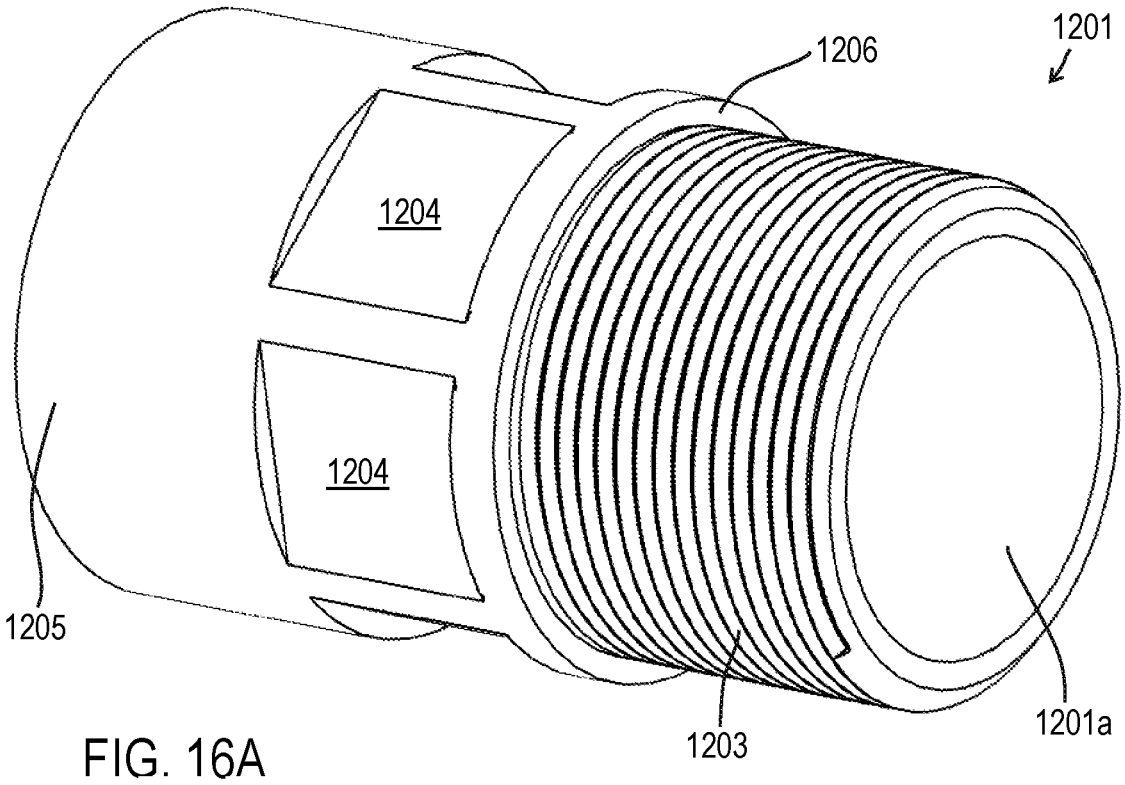
FIG. 16A is a front perspective view of a barrel nut of the handguard assembly of FIG. 11.
Figure 16B:
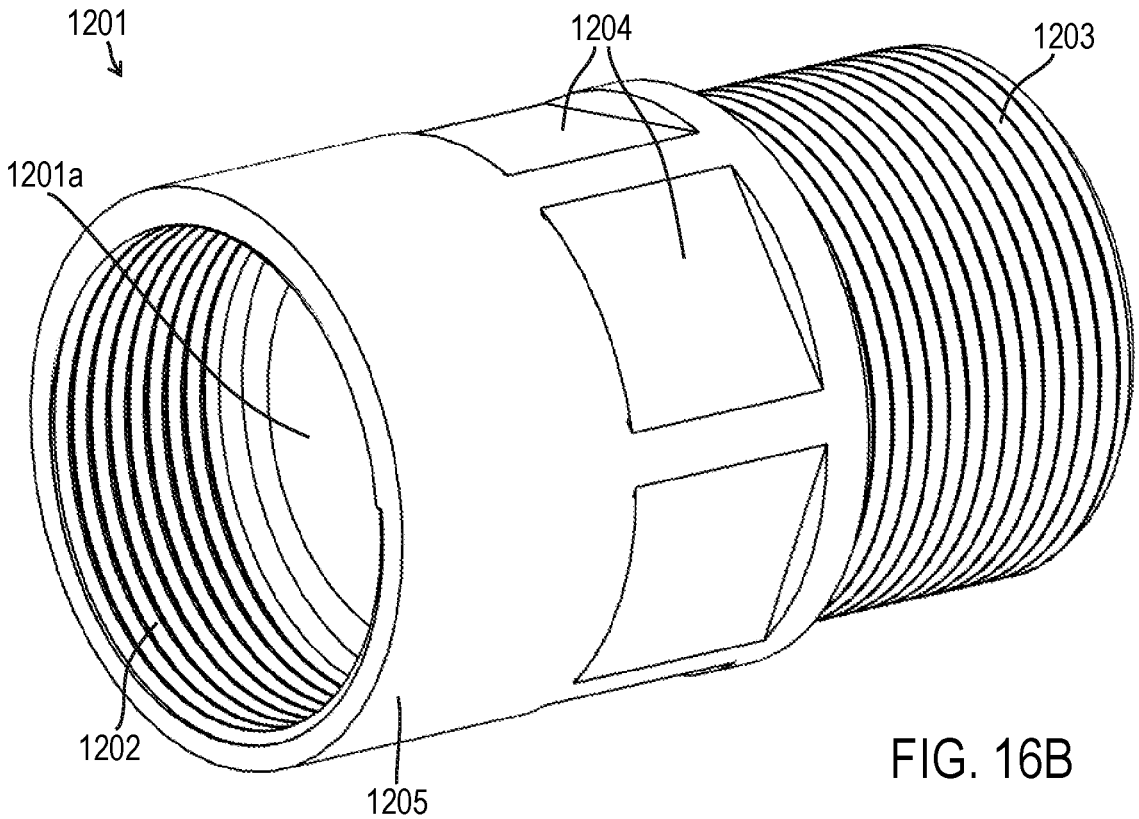
FIG. 16B is a rear perspective view of the barrel nut of FIG. 16A.

As shown in FIGS. 10-14C, the openings 1005 may have a polygonal shape and extend through a full wall thickness of the outer member 1001. Each corner of the polygon may include a radius or fillet. The shape for each of the openings 1005 may be a quadrilateral. In some cases, the shape for each of the openings 1005 may be a rectangle. In some embodiments, each opening 1005 may be aligned with a corresponding opening 1005 on the opposite side of the outer member 1001. For example, an opening 1005 on the left side of the outer member 1001 may be aligned with a corresponding opening 1005 on the right side of the outer member 1001. As shown in FIG. 14C, the outer member 1001 may include at least one opening 1005 on the lowermost surface that does not include a corresponding opening 1005 on the opposite side (i.e., the top surface). In addition, the openings 1005 may be configured to interface with standardized rail system components such as those for Modular Lock (M-LOK), KeyMod, and/or any other mounting or rail system. The openings 1005 may be included to reduce the overall weight of the outer member 1001, to reduce the volume of material needed to make the outer member 1001, for recesses to engage with the operator's fingers, to improve aesthetics, and/or any other appropriate purpose.

As shown in FIGS. 10-14B, the openings 1006 may have a polygonal shape and extend through less than a full wall thickness of the outer member 1001. Each corner of the polygon may include a radius or fillet. The shape for each of the openings 1006 may be a triangle. In some cases, the shape for each of the openings 1006 may be an isosceles triangle. In some embodiments, each opening 1006 may be aligned with a corresponding opening 1006 on the opposite side of the outer member 1001. For example, an opening 1006 on the upper left side of the outer member 1001 may be aligned with a corresponding opening 1006 on the upper right side of the outer member 1001. The openings 1006 may be included to reduce the localized thickness of the outer member 1001, to reduce the overall weight of the outer member 1001, to reduce the volume of material needed to make the outer member 1001, for recesses to engage with the operator's fingers, to improve aesthetics, and/or any other appropriate purpose. In some embodiments, the openings 1006 may be filled (or partially filled) with a secondary material such as polymer, rubber, synthetic rubber, thermoplastic polyurethane, thermoplastic elastomer, thermoplastic rubber, and/or any other appropriate material. The purpose of the secondary material may be to improve grip, tactile interface, ergonomics, aesthetics, and/or any other appropriate quality.

As shown in FIGS. 10-14C, the openings 1007 may have a polygonal shape and extend through less than a full wall thickness of the outer member 1001. Each corner of the polygon may include a radius or fillet. The shape for each of the openings 1007 may be a quadrilateral. In some cases, the shape for each of the openings 1007 may be a rectangle. In some embodiments, each opening 1007 may be aligned with a corresponding opening 1007 on the opposite side of the outer member 1001. For example, an opening 1007 on the left side of the outer member 1001 may be aligned with a corresponding opening 1007 on the right side of the outer member 1001. As shown in FIG. 14C, the outer member 1001 may include at least one opening 1007 on the lowermost surface that does not include a corresponding opening 1007 on the opposite side (i.e., the top surface). The openings 1007 may be included to reduce the localized thickness of the outer member 1001, to reduce the overall weight of the outer member 1001, to reduce the volume of material needed to make the outer member 1001, for recesses to engage with the operator's fingers, to improve aesthetics, and/or any other appropriate purpose. In some embodiments, the openings 1007 may be filled (or partially filled) with a secondary material such as polymer, rubber, synthetic rubber, thermoplastic polyurethane, thermoplastic elastomer, thermoplastic rubber, and/or any other appropriate material. The purpose of the secondary material may be to improve grip, tactile interface, ergonomics, aesthetics, and/or any other appropriate quality. In some embodiments, the openings 1007 are aligned with the threaded portion 1013 of the outer member 1001, which reduces the overall thickness of the outer member 1001 in this area.

To secure the components to one another, in some embodiments, after the barrel 50 is inserted into the upper receiver 30, the barrel nut 1201 is threaded onto the upper receiver 30 such that aft threaded portion 1202 engages the upper receiver 30 and the barrel 50 extends through the central bore 1201*a* of the barrel nut 1201 (i.e., see FIG. 10). The barrel nut 1201 may include a plurality of flat portions 1204 to allow a wrench to engage and tighten the barrel nut 1201. The outer member 1001 is then inserted (such that the barrel 50 extends into the center of the outer member 1001) until the threaded portion 1013 of the outer member 1001 reaches the forward threaded portion 1203 of the barrel nut 1201. The barrel nut 1201 is designed to fit within the rear cavity 1011 of the outer member 1001. The outer member 1001 is then threaded onto the barrel nut 201 such that the threaded portion 1013 engages the forward threaded portion 1203. The threaded portion 1013 may be an integral feature of the outer member 1001 (i.e., machined and/or molded into the outer member 1001) or the threaded portion 1013 may be a separate component inserted into the outer member 1001 (e.g., see insert 1210 shown in FIGS. 24A-25). The threaded portion 1013 may be the same material as the outer member 1001 or may be a different material. For example, in some embodiments, the outer member 1001 is a polymer and the threaded portion 1013 is a metallic insert. For example, in some embodiments, the insert 1210 (shown in FIGS. 24A-25) may be metallic. In cases where the threaded portion 1013 is a metallic insert, the threaded portion 1013 may be (i) overmolded (or co-molded) and/or (ii) mechanically attached (using fasteners, adhesive, press-fit, and/or any other appropriate method). The threaded portion 1013 (and/or the insert 1210) may be aluminum, brass, steel, titanium, and/or any other appropriate material.

In some embodiments, the barrel nut 1201 is configured such that the outer surface 1205 engages or locks with the rear cavity 1011 of the outer member 1001. The outer surface 1205 may include one or more mechanical features for engaging the rear cavity 1011. For example, the outer surface 1205 may include knurling, one or more protrusions, or other relevant features for engaging and preventing rotation of the outer member 1001. In some cases, in addition to or in lieu of the mechanical features described above, the outer surface 1205 may include a taper such that the aft-most portion of the outer surface 1205 has a larger dimension than other portions of the outer surface 1205. For example, for embodiments where the outer surface 1205 is cylindrical, the aft end of the outer surface 1205 may have a larger diameter than other portions of the outer surface 1205. Accordingly, when the outer member 1001 and the barrel nut 1201 are fully engaged with one another, the larger dimension at the aft end of the outer surface 1205 creates radial pressure onto the aft end 1002*a* of the outer member 1001.

Figure 17A:
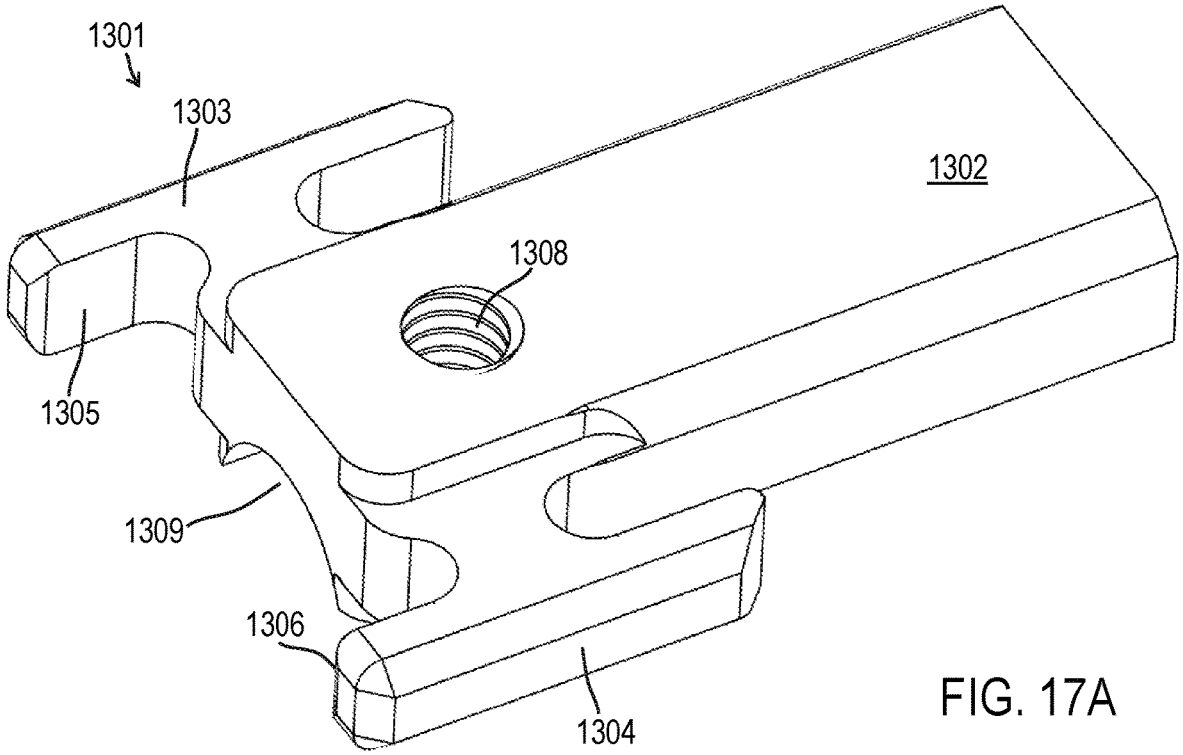
FIG. 17A is a rear perspective view of an alignment member of the handguard assembly of FIG. 11.
Figure 17B:
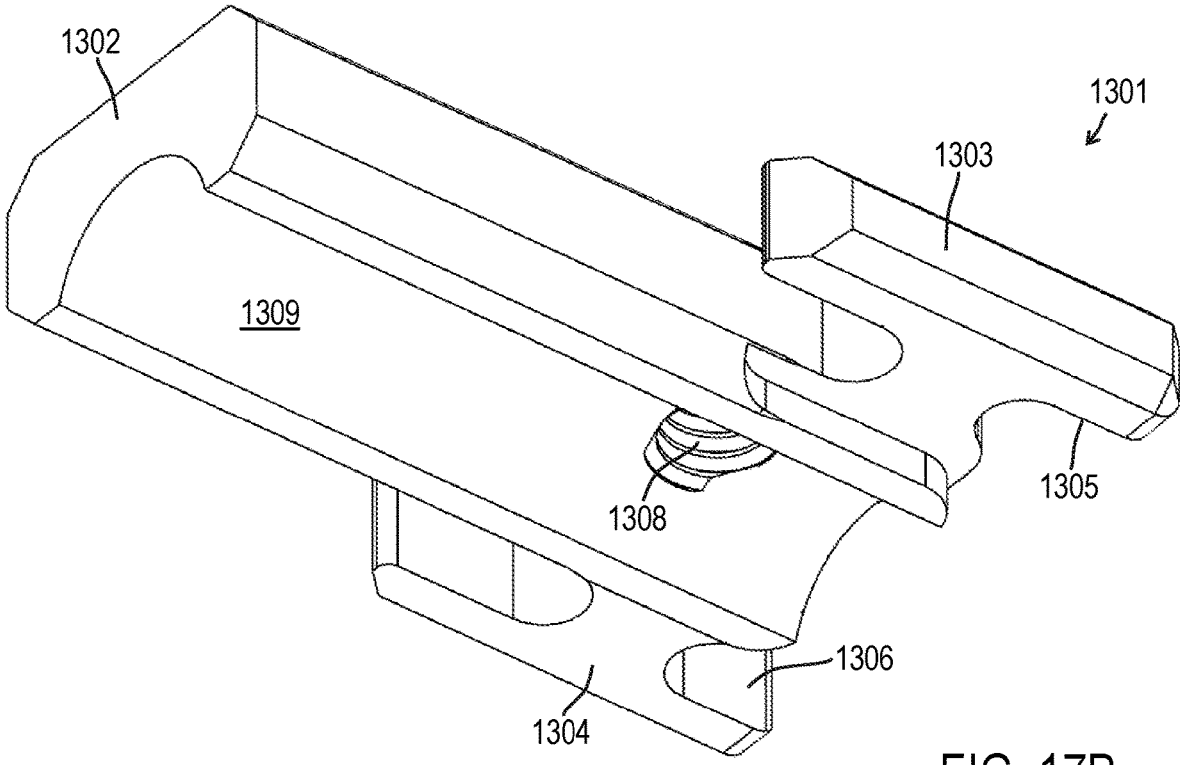
FIG. 17B is a front perspective view of the alignment member of FIG. 17A.

During the installation of the outer member 1001, the alignment member 1301 may be moved to avoid interference with the upper receiver 30. The alignment member 1301 may fit within an upper cavity 1008 of the outer member 1001. In some embodiments, the alignment member 1301 may move between a rear position (see FIG. 18A) and a forward position (see FIG. 18B). As shown in FIGS. 17A and 17B, the alignment member 1301 may include a main body 1302, a left side member 1303, and a right side member 1304. The left and right side members 1303, 1304 may extend rearward of the main body 1302 where the left side member 1303 includes an internal face 1305 and the right side member 1304 includes an internal face 1306. The main body 1302 may include a hole 1308 extending in the vertical direction, and, in some cases, the hole 1308 is closer to a rear end of the main body 1302 compared to the front. The main body 1302 may include a recess 1309 on the bottom. The recess 1309 may be cylindrical or partially cylindrical. The recess 1309 may provide clearance for an adjacent component in the firearm 1 including, for example, a component of a gas or piston system, a gas tube, a piston, or any other appropriate component. In some embodiments, when the outer member 1001 and the barrel nut 1201 are being attached to one another, the alignment member 1301 may be moved to the forward position as shown in FIG. 18B. When the alignment member 1301 is in the forward position, the rearmost portion of the alignment member 1301 (i.e., the rear part of the left and right side members 1303, 1304) is flush with or located forward of the aft end 1002*a* of the outer member 1001.

Figure 18A:
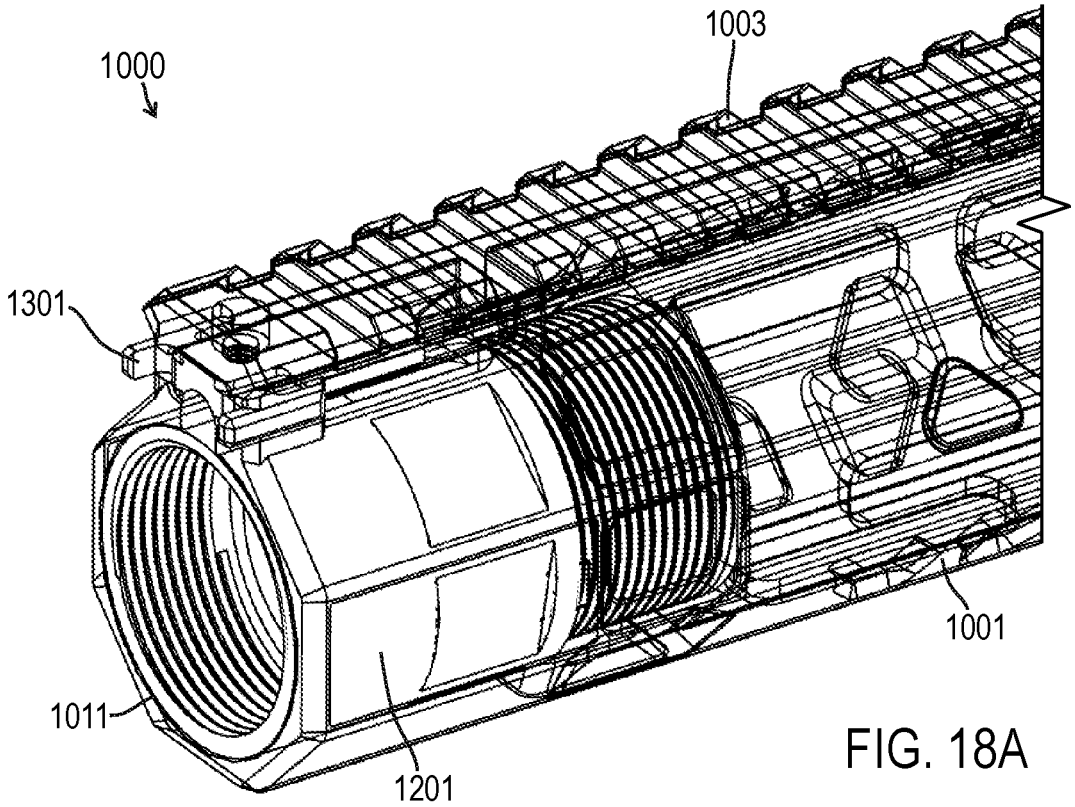
FIG. 18A is a right rear partial perspective view of the handguard assembly of FIG. 11.
Figure 18B:
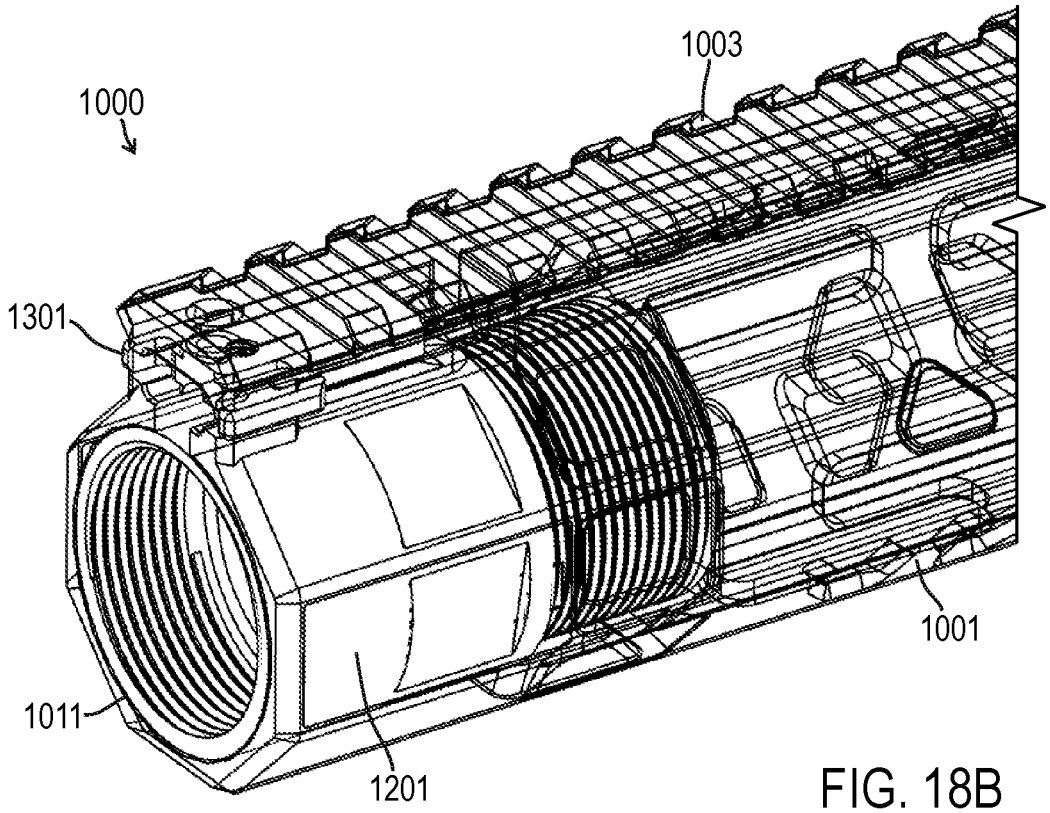
FIG. 18B is a right rear partial perspective view of the handguard assembly of FIG. 11.
Figure 19A:
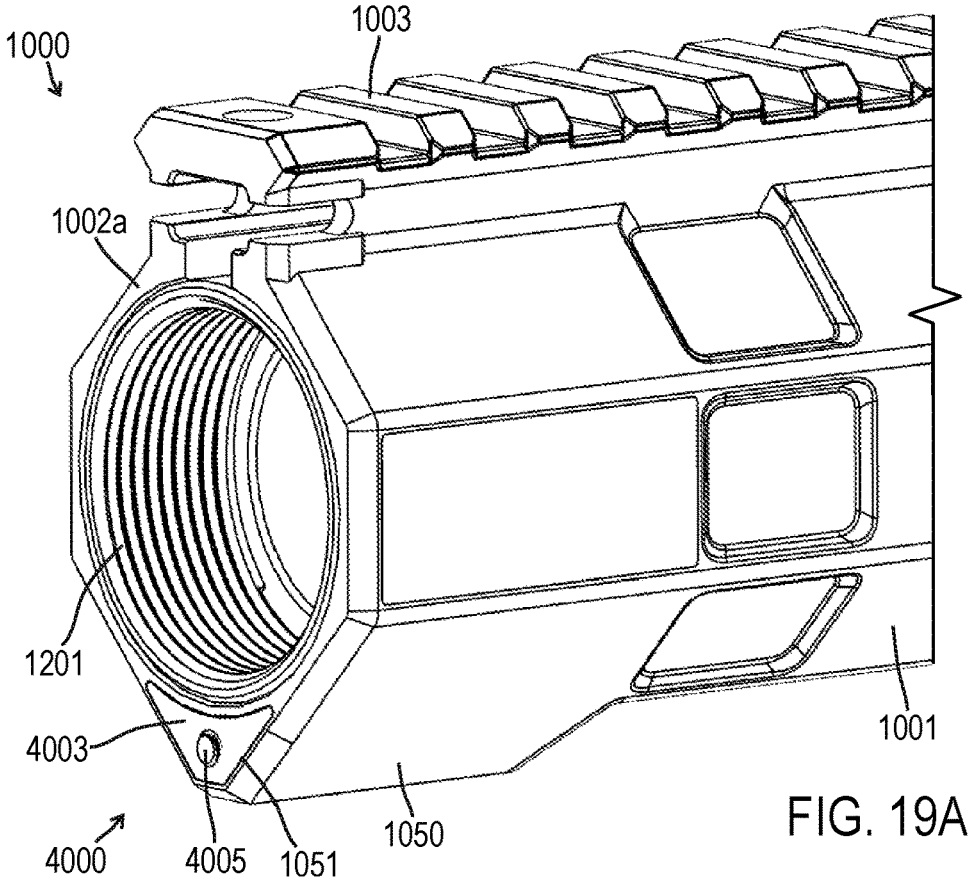
FIG. 19A is a right rear partial perspective view of the handguard assembly of FIG. 11.
Figure 19B:
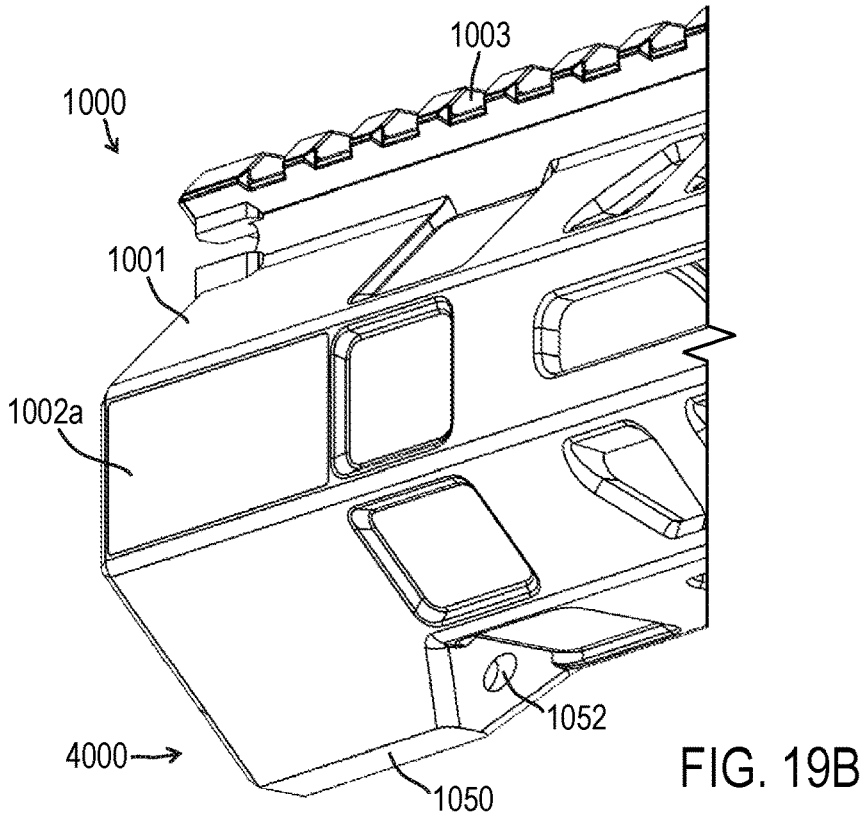
FIG. 19B is a right front partial perspective view of the handguard assembly of FIG. 19A.

In some embodiments, when the outer member 1001 is sufficiently engaged with the barrel nut 1201 and/or when the outer member 1001 is in an appropriate position relative to the upper receiver 30, the alignment member 1301 may move to the rear position shown in FIG. 18A. When the alignment member 1301 is in the rear position, (i) the internal face 1305 of the left side member 1303 is immediately adjacent to (and/or in contact with) a left side of the upper receiver 30 (i.e., just below the upper rail 31) and (ii) the internal face 1306 of the right side member 1304 is immediately adjacent to (and/or in contact with) a right side of the upper receiver 30 (i.e., just below the upper rail 31). This configuration is shown in FIG. 10. In some cases, when the alignment member 1301 is in the rear position, the hole 1308 is aligned with hole 1009 of the outer member 1001 (see FIGS. 13-14C). Alignment of holes 1308 and 1009 allows fastener 3050 to be inserted. In some embodiments, fastener 3050 passes through hole 1009 and is threaded into hole 1308. The fastener 3050 may lock the alignment member 1301 in the rear position thus preventing movement of the outer member 1001 relative to the upper receiver 30.

The internal faces 1305, 1306 may extend straight in the forward rear direction. Conversely, in some embodiments, the internal faces 1305, 1306 may taper inward when moving toward the main body 1302. Tapering the internal faces 1305, 1306 would cause the alignment member 1301 to more securely/tightly engage the upper receiver 30 as it moves rearward.

The forward threaded portion 1203 of the barrel nut 1201 and/or the threaded portion 1013 of the outer member 1001 may be a multiple start thread configuration. For example, one or both of the threaded portions may be a two-start thread configuration, a three-start thread configuration, a four-start thread configuration, or any other appropriate thread configuration. One advantage of a multiple start thread configuration is that the outer member 1001 can be started in multiple positions relative to the barrel nut 1201 in order to control the final position of the outer member 1001 relative to the upper receiver 30 (i.e., to minimize the gap between the outer member 1001 and the upper receiver 30). In particular, the outer member 1001 can be rotated onto the threaded portion 1203 of the barrel nut 1201 and will be tightened as much as possible but must stop at a position where the orientation of the outer member 1001 matches that of the upper receiver 30 (which may create a small gap between the outer member 1001 and the upper receiver 30). However, a multiple start thread configuration allows a user to minimize such a gap by adjusting the start position of the outer member 1001 relative to the barrel nut 1201.

Figure 20:
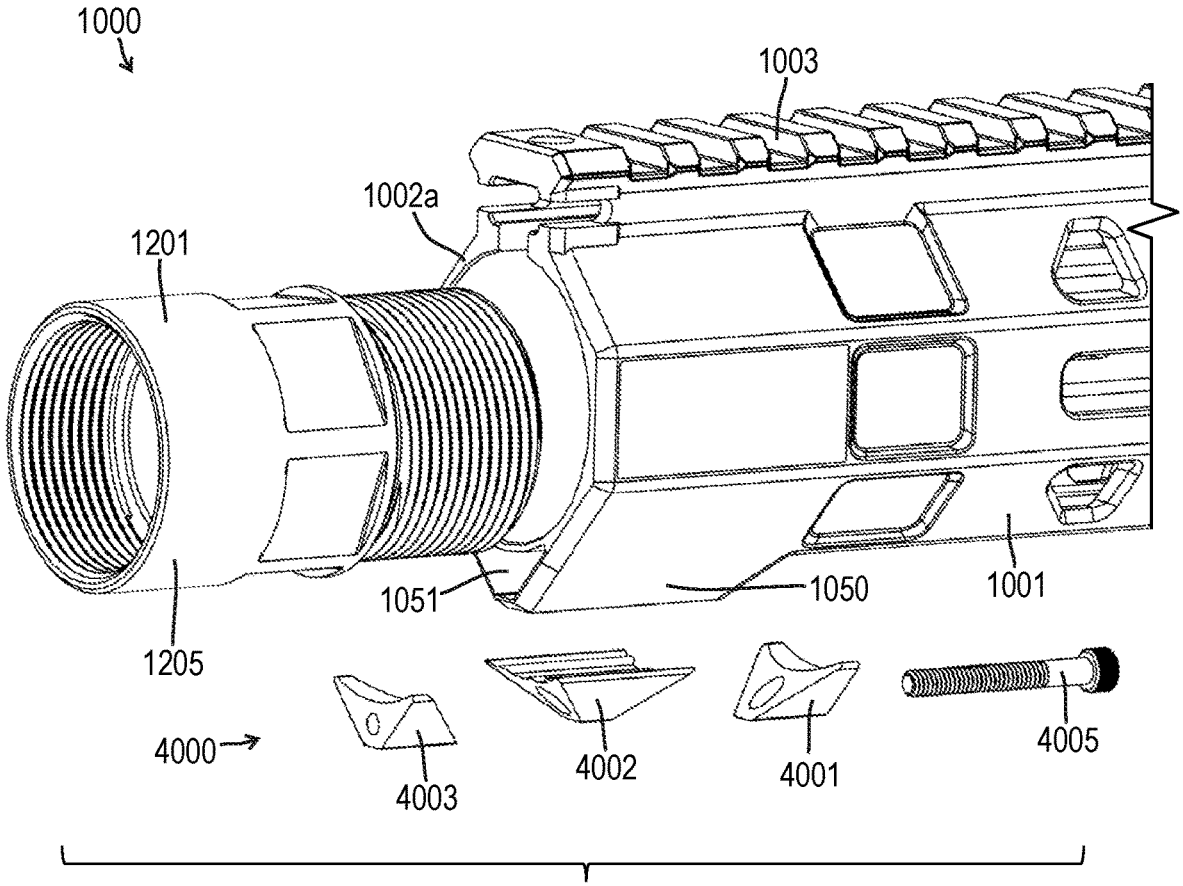
FIG. 20 is a right rear exploded perspective view of the handguard assembly of FIG. 19A.
Figure 21A:
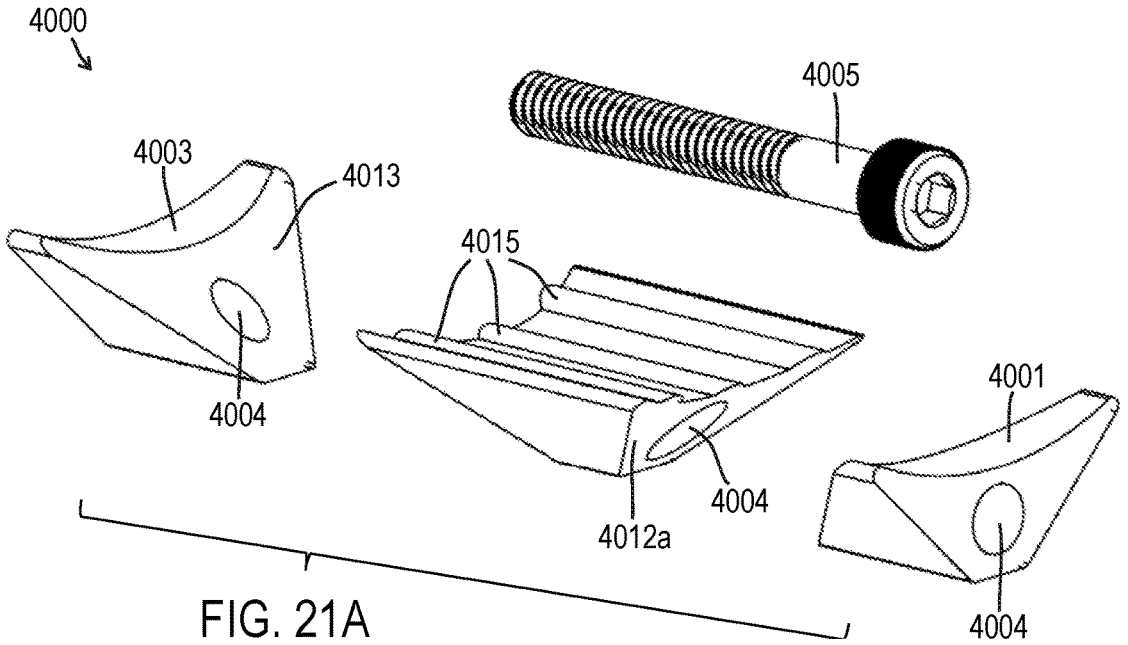
FIG. 21A is a front exploded perspective view of a locking assembly of the handguard assembly of FIG. 19A.
Figure 21B:
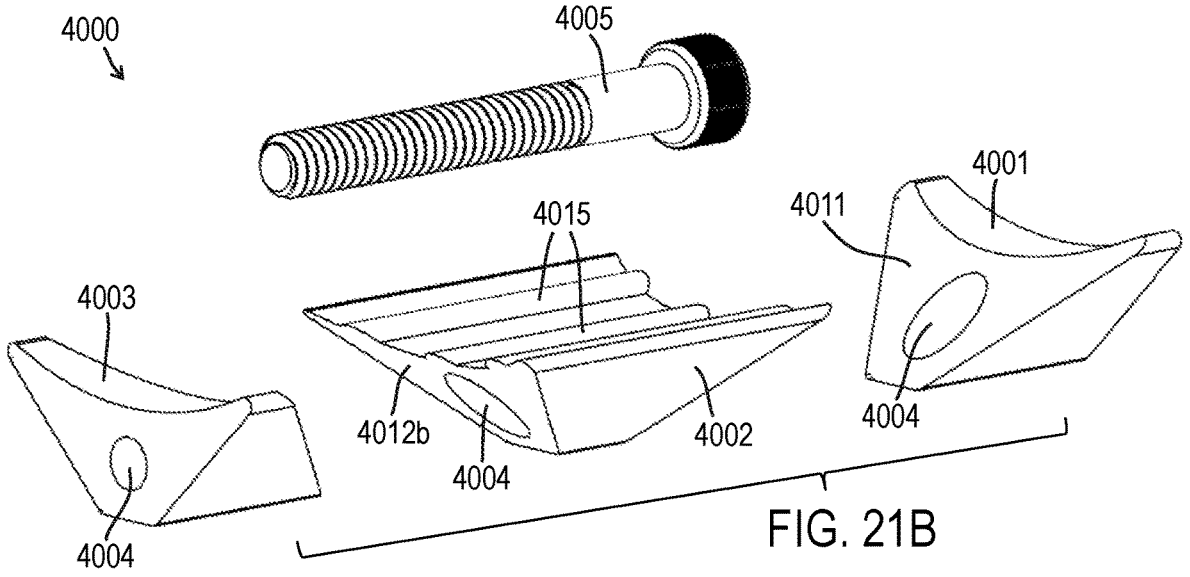
FIG. 21B is a rear exploded perspective view of the locking assembly of FIG. 21A.

As shown in FIGS. 19A-21B, the handguard assembly 1000 may include an aft locking assembly 4000 for locking and preventing rotation of the outer member 1001 relative to the barrel nut 1201. The outer member 1001 may include a lower protrusion 1050 with an internal cavity 1051 that is open on the aft side of the outer member 1001. The forward side of the lower protrusion 1050 may include a hole 1052 that allows access to a fastener 4005 (see FIG. 19B). As shown in FIGS. 20-21B, the locking assembly 4000 may include a plurality of members designed to cause the outer member 1001 to press against the outer surface 1205 of the barrel nut 1201. For example, the locking assembly 4000 may include a forward member 4001, a central member 4002, an aft member 4003, and a fastener 4005. The fastener 4005 may extend through a hole 4004 that is common to each of the members. In some cases, the aft member 4003 is threaded such that tightening the fastener 4005 causes the forward member 4001 and the aft member 4003 to move toward one another. This movement causes (i) wedge surface 4011 (of the forward member 4001) to press against surface 4012*a* (of the central member 4002) and (ii) wedge surface 4013 (of the aft member 4003) to press against surface 4012*b* (of the central member 4002). Contact with these wedge surfaces 4011, 4013 when the fastener 4005 is tightened causes the central member 4002 to move upward such that member(s) 4015 to push against the upper surface within cavity 1051. In some cases, upward pressure from the central member 4002 causes the upper surface of cavity 1051 to deflect and press against the outer surface 1205 of the barrel nut 1201. Although the drawings illustrate the member(s) 4015 as three cylindrical protrusions that extend in the forward/aft direction, the member(s) 4015 may be a flat surface, a grid of points or spikes, or any other relevant shape for engaging or gripping the barrel nut 1201.

In some embodiments, the barrel nut 1201 is made from steel alloy, titanium, aluminum alloy, and/or any other appropriate material. In other embodiments, the barrel nut 1201 is made from a 7000 series aluminum alloy (or a steel alloy) and the outer member 1001 is made from a 6000 series aluminum alloy (or a 7000 series aluminum alloy). In some embodiments, the barrel nut 1201 is made from 7075 aluminum alloy and the outer member 1001 is made from 6061 aluminum alloy. In other embodiments, the outer member 1001 is made from a polymer material. In some embodiments, the outer member 1001 is a polymer material including, for example, plastic, thermoplastic, nylon, polyetherimide, thermosetting polymer, polyoxymethylene (acetal), polytetrafluoroethylene, polyethylene, polypropylene, polyvinyl chloride, polystyrene, carbon composite, and/or other plastic or polymer materials.

The configuration of the handguard assembly 1000 may also lead to more streamlined manufacturing processes compared to conventional handguards. For example, in some embodiments, the barrel nut 1201, the alignment member 1301, and the fastener 3050 are the only metallic components while the outer member 1001 is a polymer component. In some cases, the outer member 1001 is injection molded in a single step. In other words, the most complex portions of the handguard assembly 1000 (i.e., the overall shape, the upper rail 1003, the openings 1004-1007, etc.) may be injection molded in a single step. As described above, in some cases, the injection molding process may include a second step where the secondary material is injected into some of the openings (e.g., openings 1006 and/or openings 1007). Injection molding the outer member 1001 significantly reduces overall manufacturing time compared to a conventional fully machined handguard.

As shown in FIGS. 22-27B, in some cases, a handguard assembly 2000 includes an outer member 2001, a barrel nut 1201, a threaded portion 1210, fasteners 2401, 2402, and at least one alignment member 2301, 2302. The outer member 2001 may include an aft end 2002*a*, a forward end 2002*b*, an upper rail 2003, and an array of openings 2004-2007. The upper rail 2003 may include an aft end 2003*a* and a forward end 2003*b*. The upper rail 2003 may be a Picatinny rail (MIL-STD-1913 rail or STANAG 2324 rail), a Weaver rail, or any other appropriate rail. In some embodiments, the aft end 2002*a* of the outer member 2001 may be designed to interface with the barrel nut 1201. In particular, as shown in FIGS. 23-26A, the aft end 2002*a* may include a rear cavity 2011. The barrel nut 1201 may at least partially fit within the rear cavity 2011. In some cases, the threaded portion 1210 is an insert 1210 that is overmolded with the outer member 2001 (and therefore permanently attached). The insert 1210 may be designed with a threaded portion 1212 to attach to the forward threaded portion 1203 of the barrel nut 1201. In other embodiments, the insert 1210 and barrel nut 1201 may be attached in a variety of ways including press-fit, adhesive, overmolding (or co-molding), threaded attachment, and/or any other appropriate type of attachment. The insert 1210 may include an outer textured surface 1211 (e.g., knurling) along with the internal threaded portion 1212. FIG. 24A shows the rear portion of the handguard assembly 2000 where the outer member 2001 is transparent showing the barrel nut 1201 threaded into the insert 1210. FIG. 24B is a similar view without the barrel nut 1201.

Figure 22:
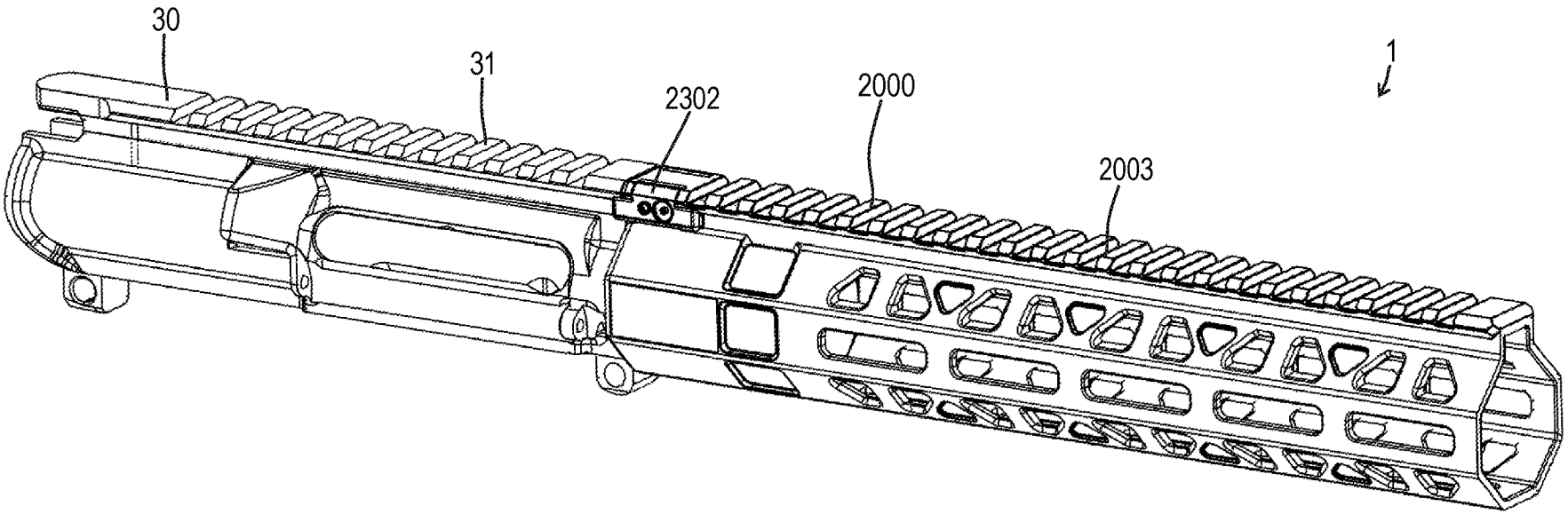
FIG. 22 is a front perspective view of a firearm according to certain embodiments of the present invention.

As shown in FIG. 22, the handguard assembly 2000 may be arranged adjacent to an upper receiver 30 of a firearm 1 such that the upper rail 2003 forms a continuous rail with the upper rail 31 of the upper receiver 30. In some cases, the handguard assembly 2000 may be mounted such that the aft end 2003*a* of the upper rail 2003 is immediately adjacent to and/or in contact with the forward end of the upper rail 31 of the upper receiver 30.

The outer member 2001 may be configured as a free float handguard and may be available in various lengths (based on operator preference, barrel length, and/or any other appropriate factor). For example, as shown in the drawings, the outer member 2001 may have an intermediate length. In some cases, the outer member 2001 may be approximately 10"-11" (254 mm-280 mm). In other cases, the outer member 2001 may be approximately 5"-6" (127 mm-153 mm). In some embodiments, the outer member 2001 may be approximately 13"-15" (330 mm-381 mm). In other embodiments, the outer member 2001 may be approximately 8"-9"(203 mm-229 mm). In some cases, the forward end 2002*b* may be designed to extend approximately to the end of the barrel 50 where the barrel 50 can be any length from approximately 1"-24" (25.4 mm-609.6 mm) or any other appropriate length. In some cases, the outer member 2001 is configured such that the forward end 2002*b* is located before an end of the barrel 50 such that the barrel 50 extends beyond the outer member 2001 and a portion of the barrel 50 is exposed. In other cases, the outer member 2001 is configured such that the forward end 2002*b* is beyond an end of the barrel 50 such that the barrel 50 and at least a portion of a muzzle device (muzzle brake, compensator, flash hider, suppressor, etc.) is covered by (i.e., located within) the outer member 2001.

In some embodiments, the cross-section of the outer member 2001 is approximately polygonal. For example, the outer member 2001 may be approximately hexagonal or octagonal where the side oriented at the top of the outer member 2001 is offset in the vertical direction to form the upper rail 2003. In addition to hexagonal or octagonal, the cross-section of the outer member 2001 may be any shape including circular, square, rectangular, pentagonal, heptagonal, nonagonal, decagonal, or any other appropriate shape.

As shown in FIGS. 22-26B, the outer member 2001 may include a plurality of openings 2004-2007. The openings 2004-2007 may enhance an operator's grip, provide a path for convective air cooling, improve aesthetic appearance, and/or provide various other benefits. The examples of the outer member 2001 shown in FIGS. 22-26B include four types of openings 2004-2007. However, it should be understood that the outer member 2001 may include any number of types of openings including shape, size, quantity, configuration, depth, and/or any other characteristic. The outer member 2001 may also include a rear upper cavity 2010 (e.g., see FIGS. 23-26A). The rear upper cavity 2010 may provide clearance for an adjacent component in the firearm including, for example, a component of a gas or piston system, a gas tube, a piston, or any other appropriate component.

In some embodiments, the openings 2004 may have a polygonal shape and extend through a full wall thickness of the outer member 2001 (see FIGS. 22-26B). Each corner of the polygon may include a radius or fillet. The shape for each of the openings 2004 may be a quadrilateral. In some cases, the shape for each of the openings 2004 may be a trapezoid. As shown in the figures, the shape for each of the openings 2004 may be a right trapezoid. In some embodiments, each opening 2004 may be aligned with a corresponding opening 2004 on the opposite side of the outer member 2001. For example, an opening 2004 on the upper left side of the outer member 2001 may be aligned with a corresponding opening 2004 on the upper right side of the outer member 2001. In some cases, the inner surfaces or flanges of each opening 2004 extends in a horizontal direction (i.e., not perpendicular to the local surface of the outer member 2001). In addition, the openings 2004 may be configured to interface with standardized rail system components such as those for Modular Lock (M-LOK), KeyMod, and/or any other mounting or rail system. The openings 2005 may be included to reduce the overall weight of the outer member 2001, to reduce the volume of material needed to make the outer member 2001, for recesses to engage with the operator's fingers, to improve aesthetics, and/or any other appropriate purpose.

As shown in FIGS. 22-26B, the openings 2005 may have a polygonal shape and extend through a full wall thickness of the outer member 2001. Each corner of the polygon may include a radius or fillet. The shape for each of the openings 2005 may be a quadrilateral. In some cases, the shape for each of the openings 2005 may be a rectangle. In some embodiments, each opening 2005 may be aligned with a corresponding opening 2005 on the opposite side of the outer member 2001. For example, an opening 2005 on the left side of the outer member 2001 may be aligned with a corresponding opening 2005 on the right side of the outer member 2001. The outer member 2001 may include at least one opening 2005 on the lowermost surface that does not include a corresponding opening 2005 on the opposite side (i.e., the top surface), which is shown in FIGS. 24A and 24B. In addition, the openings 2005 may be configured to interface with standardized rail system components such as those for Modular Lock (M-LOK), KeyMod, and/or any other mounting or rail system. The openings 2005 may be included to reduce the overall weight of the outer member 2001, to reduce the volume of material needed to make the outer member 2001, for recesses to engage with the operator's fingers, to improve aesthetics, and/or any other appropriate purpose.

As shown in FIGS. 22-26B, the openings 2006 may have a polygonal shape and extend through less than a full wall thickness of the outer member 2001. Each corner of the polygon may include a radius or fillet. The shape for each of the openings 2006 may be a triangle. In some cases, the shape for each of the openings 2006 may be an isosceles triangle. In some embodiments, each opening 2006 may be aligned with a corresponding opening 2006 on the opposite side of the outer member 2001. For example, an opening 2006 on the upper left side of the outer member 2001 may be aligned with a corresponding opening 2006 on the upper right side of the outer member 2001. The openings 2006 may be included to reduce the localized thickness of the outer member 2001, to reduce the overall weight of the outer member 2001, to reduce the volume of material needed to make the outer member 2001, for recesses to engage with the operator's fingers, to improve aesthetics, and/or any other appropriate purpose. In some embodiments, the openings 2006 may be filled (or partially filled) with a secondary material such as polymer, rubber, synthetic rubber, thermoplastic polyurethane, thermoplastic elastomer, thermoplastic rubber, and/or any other appropriate material. The purpose of the secondary material may be to improve grip, tactile interface, ergonomics, aesthetics, and/or any other appropriate quality.

As shown in FIGS. 22-26B, the openings 2007 may have a polygonal shape and extend through less than a full wall thickness of the outer member 2001. Each corner of the polygon may include a radius or fillet. The shape for each of the openings 2007 may be a quadrilateral. In some cases, the shape for each of the openings 2007 may be a rectangle. In some embodiments, each opening 2007 may be aligned with a corresponding opening 2007 on the opposite side of the outer member 2001. For example, an opening 2007 on the left side of the outer member 2001 may be aligned with a corresponding opening 2007 on the right side of the outer member 2001. The outer member 2001 may include at least one opening 2007 on the lowermost surface that does not include a corresponding opening 2007 on the opposite side (i.e., the top surface), which is shown in FIGS. 24A and 24B. The openings 2007 may be included to reduce the localized thickness of the outer member 2001, to reduce the overall weight of the outer member 2001, to reduce the volume of material needed to make the outer member 2001, for recesses to engage with the operator's fingers, to improve aesthetics, and/or any other appropriate purpose. In some embodiments, the openings 2007 may be filled (or partially filled) with a secondary material such as polymer, rubber, synthetic rubber, thermoplastic polyurethane, thermoplastic elastomer, thermoplastic rubber, and/or any other appropriate material. The purpose of the secondary material may be to improve grip, tactile interface, ergonomics, aesthetics, and/or any other appropriate quality. In some embodiments, the openings 2007 are aligned with the insert 1210 of the outer member 2001, which reduces the overall thickness of the outer member 2001 in this area.

Figure 25:
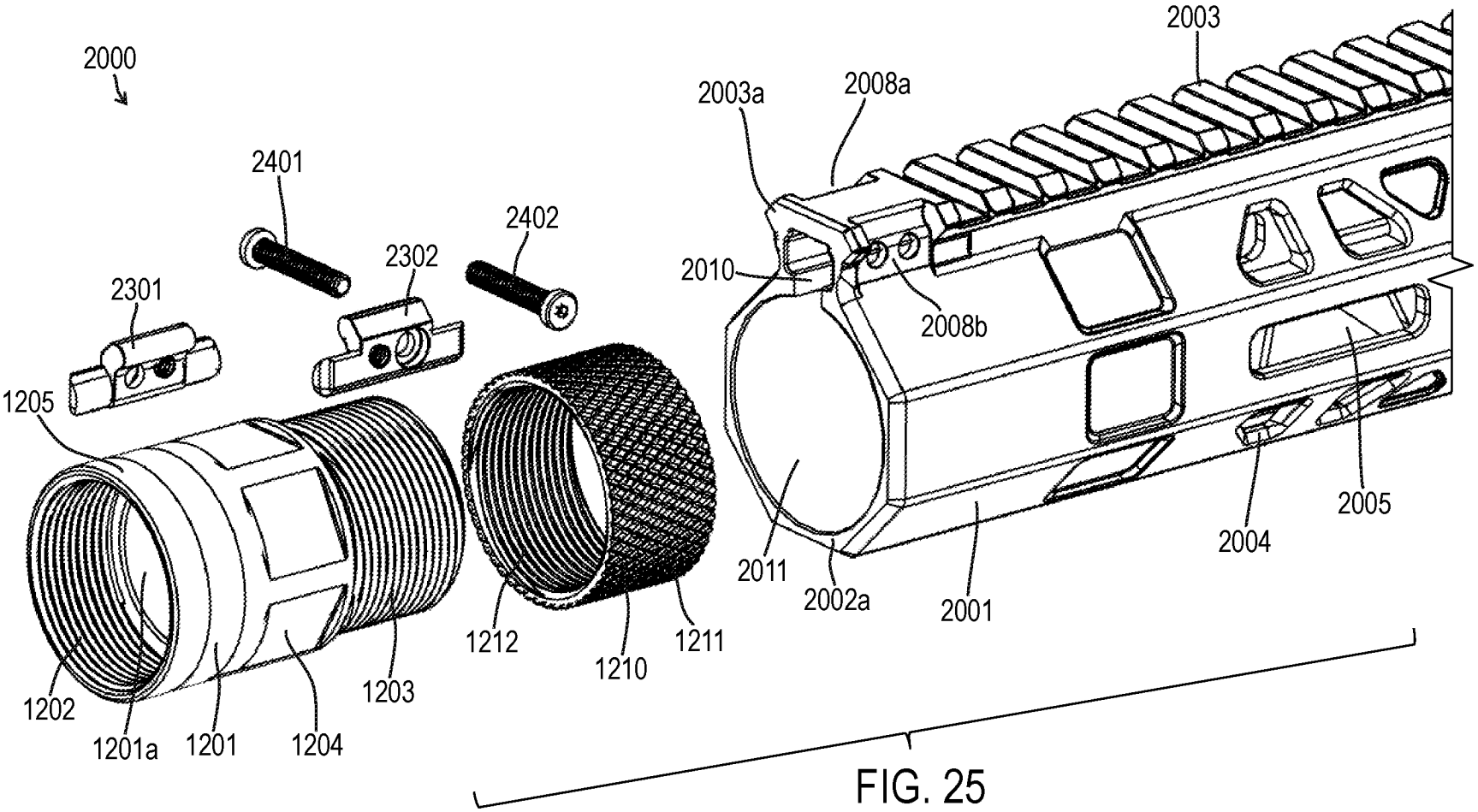
FIG. 25 is an exploded perspective view of the handguard assembly of FIG. 22.

To secure the components to one another, in some embodiments, after the barrel 50 is inserted into the upper receiver 30, the barrel nut 1201 is threaded onto the upper receiver 30 such that aft threaded portion 1202 engages the upper receiver 30 and the barrel 50 extends through the central bore 1201*a* of the barrel nut 1201 (i.e., see FIG. 25). The barrel nut 1201 may include a plurality of flat portions 1204 to allow a wrench to engage and tighten the barrel nut 1201. The outer member 2001 is then inserted (such that the barrel 50 extends into the center of the outer member 2001) until the insert 1210 reaches the forward threaded portion 1203 of the barrel nut 1201. The barrel nut 1201 is designed to fit within the rear cavity 2011 of the outer member 2001. The outer member 2001 is then threaded onto the barrel nut 1201 such that the insert 1210 engages the forward threaded portion 1203. The insert 1210 may be the same material as the outer member 2001 or may be a different material. For example, in some embodiments, the outer member 2001 is a polymer and the insert 1210 is a metallic insert. In cases where the threaded portion 1013 is a metallic insert, the threaded portion 1013 may be (i) overmolded (or co-molded) and/or (ii) mechanically attached (using fasteners, adhesive, press-fit, and/or any other appropriate method). The threaded portion 1013 (and/or the insert 1210) may be aluminum, brass, steel, titanium, and/or any other appropriate material.

Figure 23:
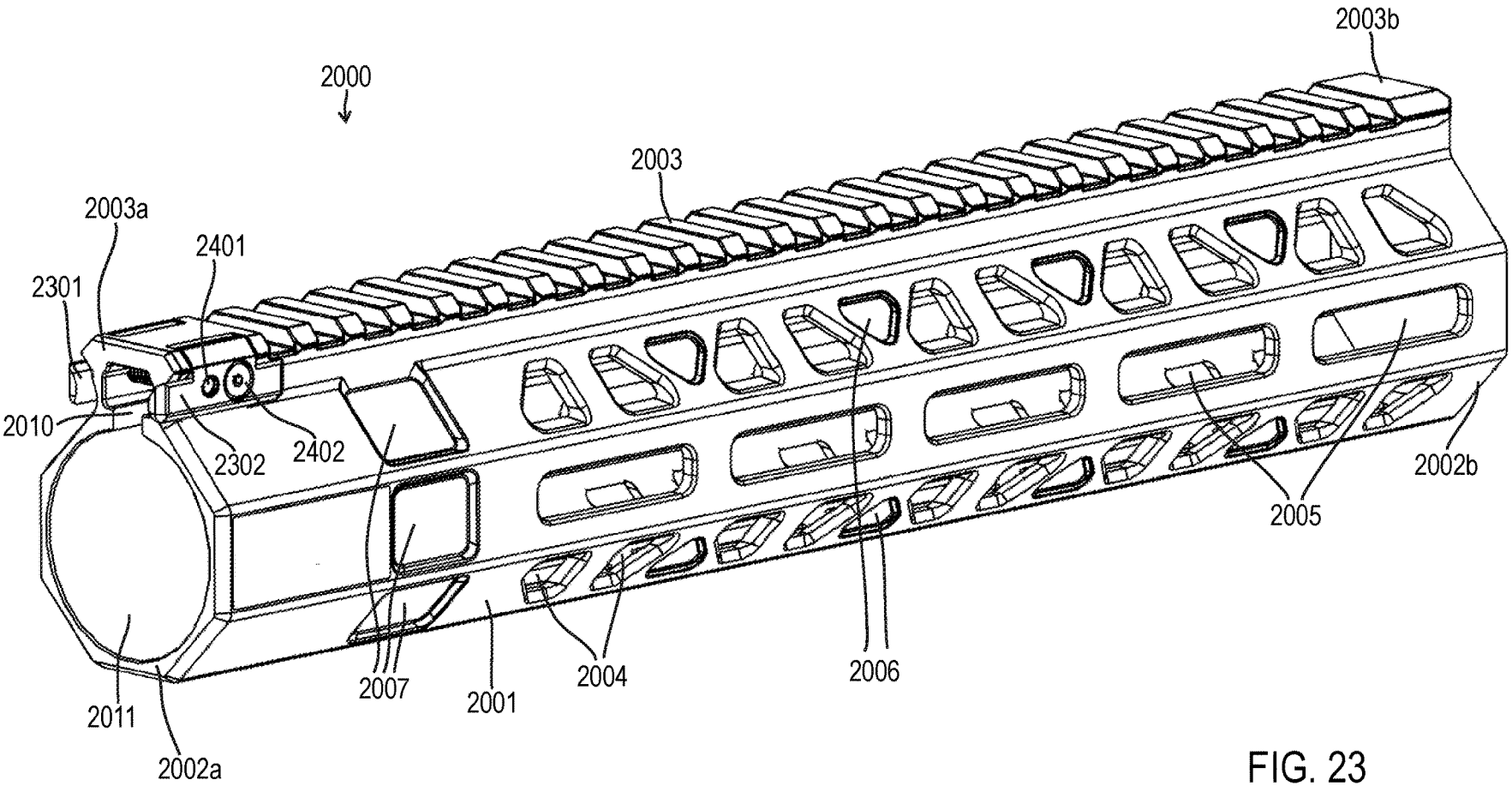
FIG. 23 is a right rear perspective view of a handguard assembly of the firearm of FIG. 22.
Figure 24A:
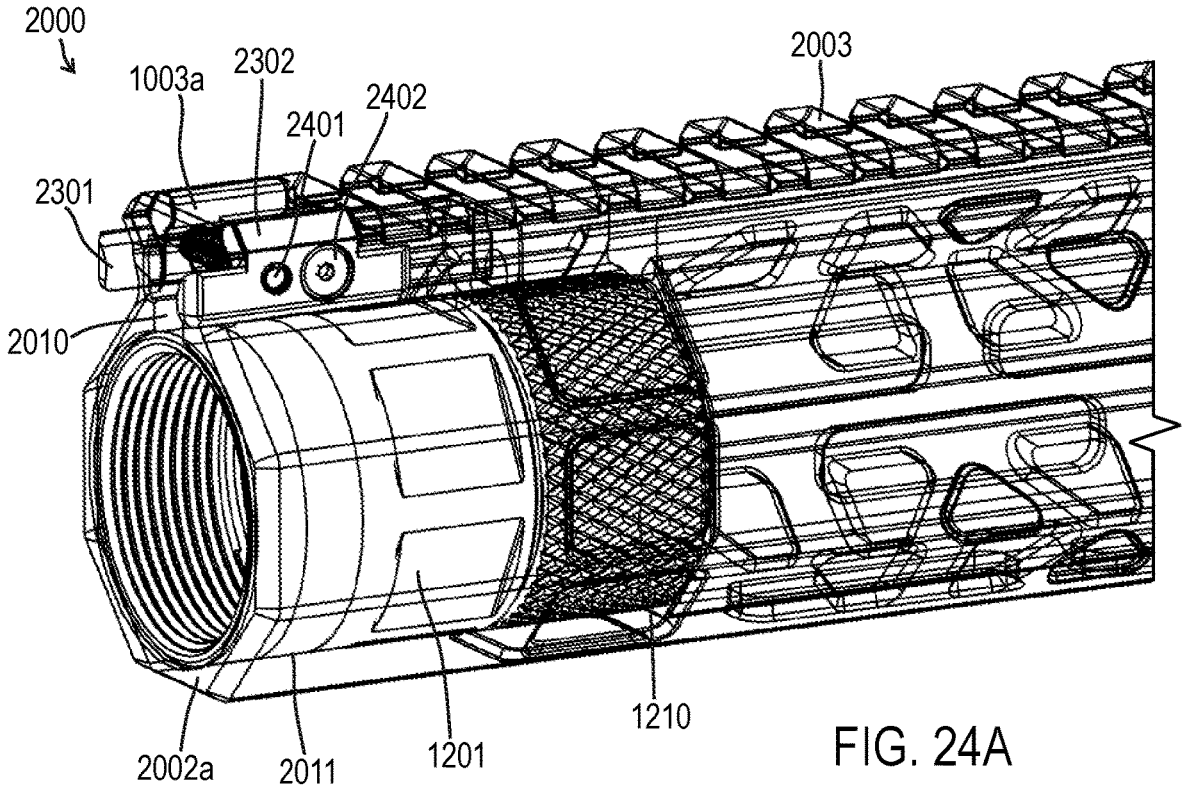
FIGS. 24A and 24B are right rear perspective views of the handguard assembly of FIG. 22.
Figure 24B:
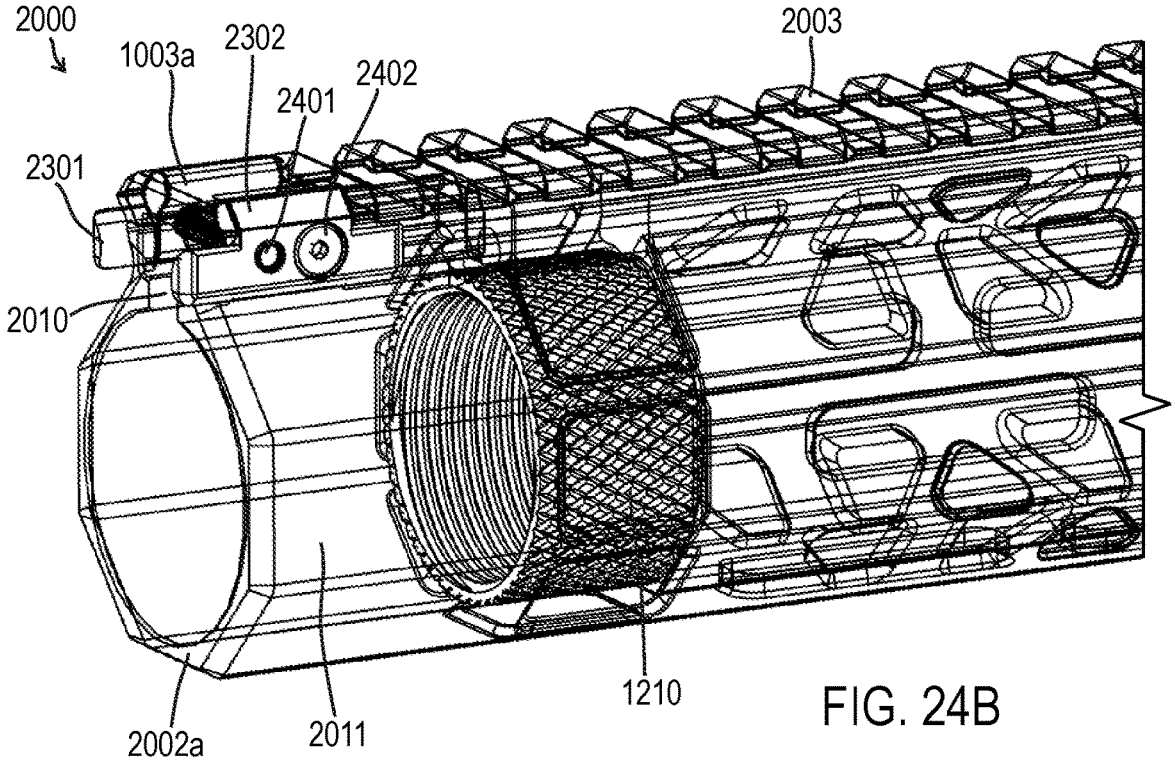
Figure 26A:
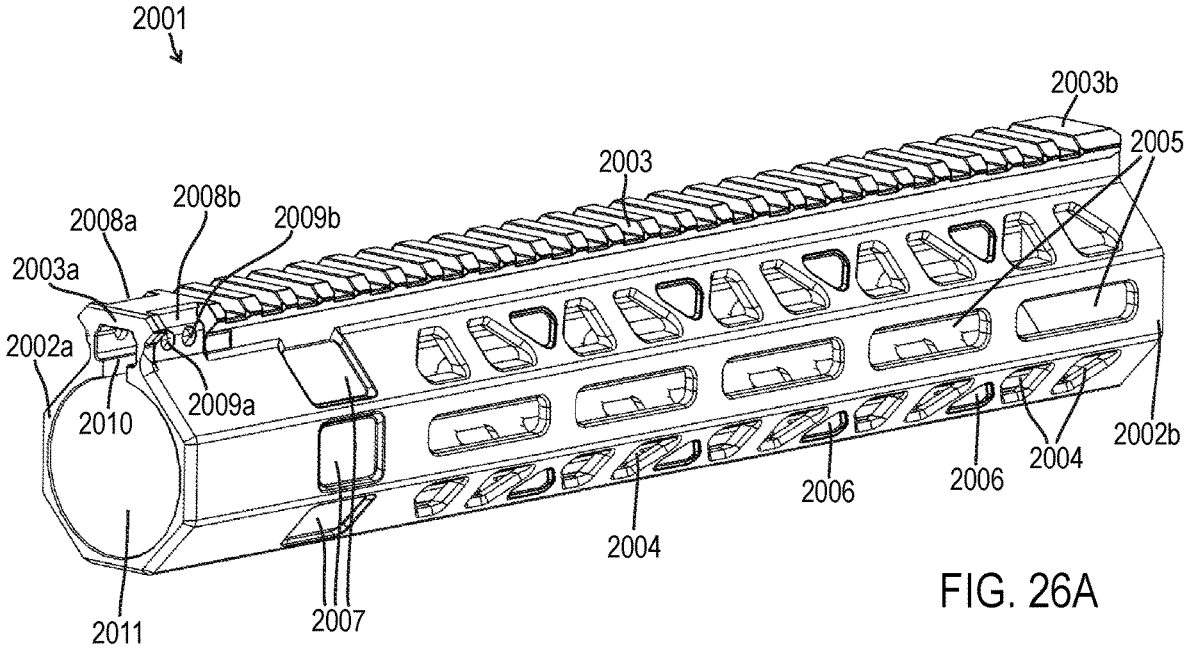
FIG. 26A is a right rear perspective view of an outer member of the handguard assembly of FIG. 22.
Figure 26B:
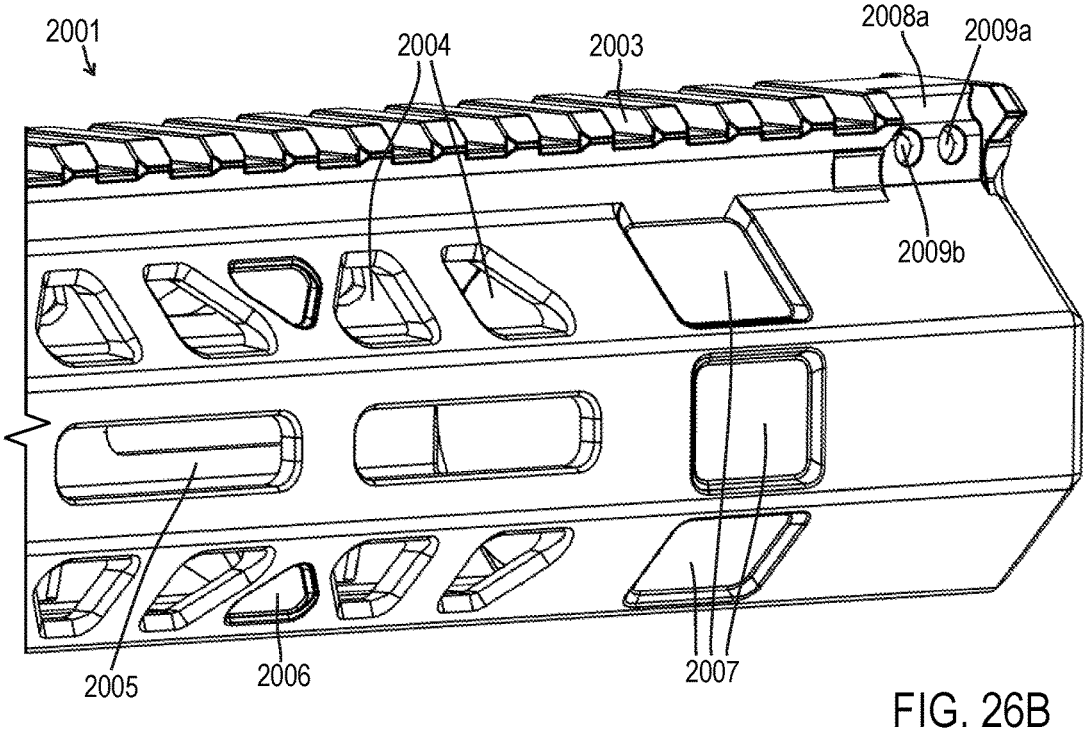
FIG. 26B is a left front partial perspective view of the outer member of FIG. 26A.
Figure 27A:
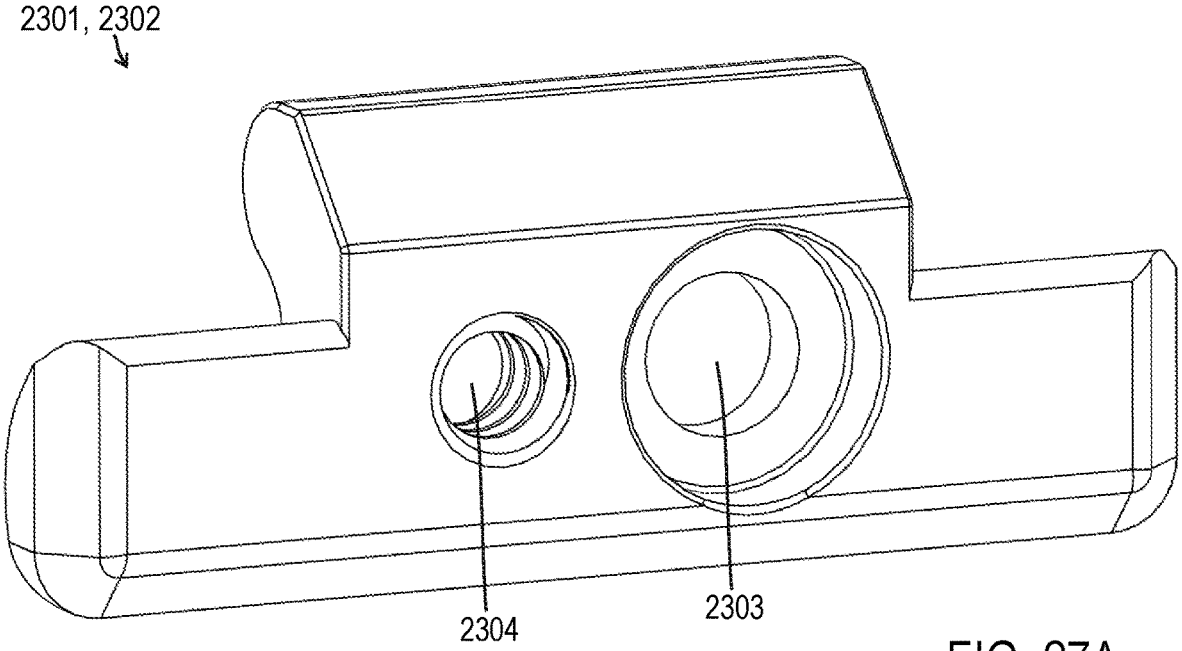
FIG. 27A is an outer perspective view of an alignment member of the handguard assembly of FIG. 22.
Figure 27B:
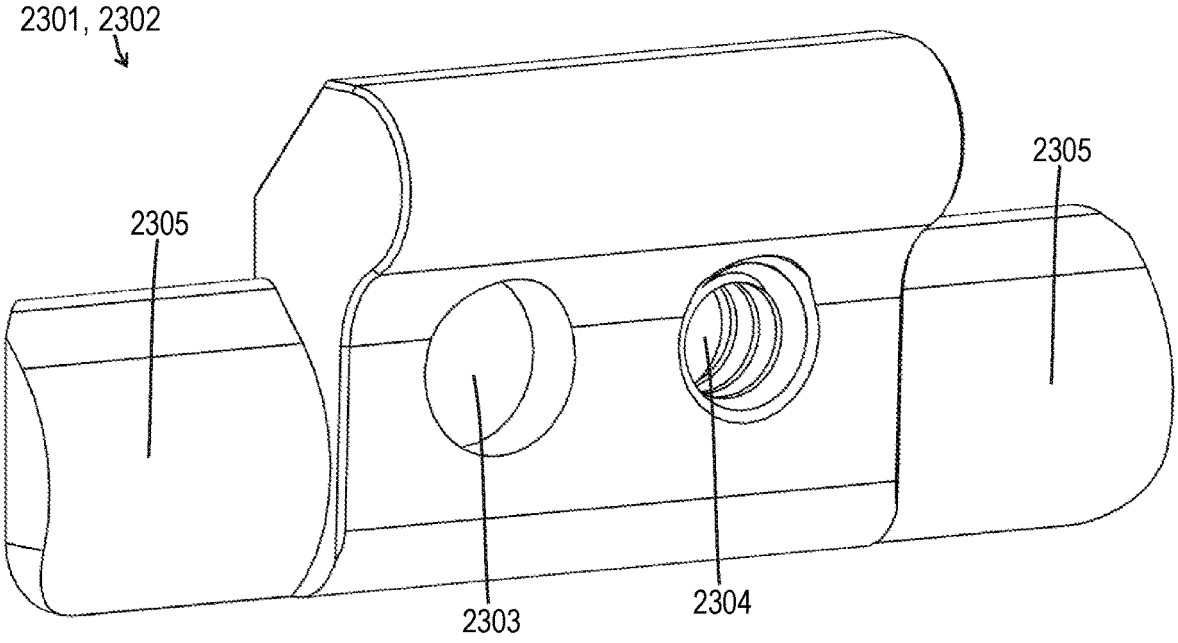
FIG. 27B is an inner perspective view of the alignment member of FIG. 27A.

The at least one alignment member(s) 2301, 2302 may function to keep the outer member 2001 aligned with the upper receiver 30. As shown in FIGS. 27A and 27B, each at least one alignment member 2301, 2302 may include a counterbored hole 2303, a threaded hole 2304, and at least one portion 2305 extending in the forward/aft direction. In some embodiments, a left alignment member 2301 is identical to a right alignment member 2302. As shown in FIGS. 26A and 26B, the outer member 2001 may include a left recess 2008*a* and a right recess 2008*b* that correspond to the locations of the alignment members 2301 and 2302, respectively. In addition, the outer member 2001 may include at least one through hole 2009. For example, as shown in FIGS. 26A and 26B, the outer member 2001 may include a rear hole 2009*a* and a forward hole 2009*b* that correspond to the locations of the holes 2303, 2304. In an assembled configuration, the left alignment member 2301 is located within the left recess 2008*a* and the right alignment member 2302 is located within the right recess 2008*b*. In such a configuration, fastener 2401 passes through: (i) counterbored hole 2303 of the left alignment member 2301; (ii) rear hole 2009*a* of the outer member 2001, and (iii) threaded hole 2304 of the right alignment member 2302. Similarly, fastener 2402 may pass through: (i) counterbored hole 2303 of the right alignment member 2302; (ii) forward hole 2009*b* of the outer member 2001, and (iii) threaded hole 2304 of the left alignment member 2301. As shown in FIGS. 23-24B, each alignment member 2301, 2302 includes a part of a portion 2305 that extends rearward of the outer member 2001. These portions 2305 engage the upper receiver 30 as shown in FIG. 22. The two fasteners 2401, 2402 can tighten and align the handguard assembly 2000 and the upper receiver 30.

In addition, in some embodiments, the barrel nut 1201 is configured such that the outer surface 1205 engages or locks with the rear cavity 1011 of the outer member 1001. The outer surface 1205 may include one or more mechanical features for engaging the rear cavity 2011. For example, the outer surface 1205 may include knurling, one or more protrusions, or other relevant features for engaging and preventing rotation of the outer member 2001. In some cases, in addition to or in lieu of the mechanical features described above, the outer surface 1205 may include a taper such that the aft-most portion of the outer surface 1205 has a larger dimension than other portions of the outer surface 1205. For example, for embodiments where the outer surface 1205 is cylindrical, the aft end of the outer surface 1205 may have a larger diameter than other portions of the outer surface 1205. Accordingly, when the outer member 2001 and the barrel nut 1201 are fully engaged with one another, the larger dimension at the aft end of the outer surface 1205 creates radial pressure onto the aft end 2002*a* of the outer member 2001.

In some embodiments, the barrel nut 1201 is made from steel alloy, titanium, aluminum alloy, and/or any other appropriate material. In other embodiments, the barrel nut 1201 is made from a 7000 series aluminum alloy (or a steel alloy) and the outer member 2001 is made from a 6000 series aluminum alloy (or a 7000 series aluminum alloy). In some embodiments, the barrel nut 1201 is made from 7075 aluminum alloy and the outer member 2001 is made from 6061 aluminum alloy. In other embodiments, the outer member 2001 is made from a polymer material. In some embodiments, the outer member 2001 is a polymer material including, for example, plastic, thermoplastic, nylon, polyetherimide, thermosetting polymer, polyoxymethylene (acetal), polytetrafluoroethylene, polyethylene, polypropylene, polyvinyl chloride, polystyrene, carbon composite, and/or other plastic or polymer materials.

The configuration of the handguard assembly 2000 may also lead to more streamlined manufacturing processes compared to conventional handguards. For example, in some embodiments, the barrel nut 1201, the threaded portion 1210, the alignment member 2301-2302, and the fasteners 2401-2402 are the only metallic components while the outer member 2001 is a polymer component. In some cases, the outer member 2001 is injection molded in a single step. In other words, the most complex portions of the handguard assembly 2000 (i.e., the overall shape, the upper rail 2003, the openings 2004-2007, etc.) may be injection molded in a single step. As described above, in some cases, the injection molding process may include a second step where the secondary material is injected into some of the openings (e.g., openings 2006 and/or openings 2007). Injection molding the outer member 2001 significantly reduces overall manufacturing time compared to a conventional fully machined handguard.

The components of any of the components described herein may be formed of materials including, but not limited to, thermoplastic, carbon composite, plastic, nylon, polyetherimide, steel, aluminum, stainless steel, high strength aluminum alloy, other plastic or polymer materials, other metallic materials, other composite materials, or other similar materials. Moreover, the components of the firearms may be attached to one another via suitable fasteners, which include, but are not limited to, screws, bolts, rivets, welds, over-molding, co-molding, injection molding, or other mechanical or chemical fasteners.

Different arrangements of the components depicted in the drawings or described above, as well as components and steps not shown or described, are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A handguard assembly for a firearm comprising:

an outer member disposed forward of an upper receiver of the firearm, the outer member comprising a rear cavity and a threaded portion;

a barrel nut disposed within the rear cavity; and at least one alignment member, wherein the at least one alignment member contacts both the outer member and the upper receiver for alignment.

2. The handguard assembly of claim 1, wherein the outer member comprises a polymer material.

3. The handguard assembly of claim 1, wherein the at least one alignment member comprises two alignment members.

4. The handguard assembly of claim 3, wherein the two alignment members are connected to one another using a plurality of fasteners that pass through the outer member.

5. The handguard assembly of claim 3, wherein the two alignment members are identical.

6. The handguard assembly of claim 1, wherein the threaded portion comprises an insert that is a separate component from the outer member.

7. The handguard assembly of claim 6, wherein the insert is metallic and outer member comprises a polymer material.

8. The handguard assembly of claim 7, wherein the insert is overmolded as a permanent component of the outer member.

9. The handguard assembly of claim 1, wherein an outer surface of the barrel nut comprises a taper such that the aft-most portion of the outer surface has a larger dimension than other portions of the outer surface.

10. The handguard assembly of claim 1, wherein the at least one alignment member is metallic and comprises a counterbored hole and a threaded hole.

11. A free float handguard assembly for a firearm comprising:

an outer member comprising a rear cavity;

a barrel nut disposed within the rear cavity; and at least one alignment member disposed adjacent to an upper rail of the outer member, wherein:

the outer member comprises a threaded portion that is removably attached to the barrel nut; and the at least one alignment member aligns the outer member relative to the firearm.

12. The free float handguard assembly of claim 11, wherein the at least one alignment member contacts both the outer member and an upper receiver of the firearm for alignment.

13. The free float handguard assembly of claim 11, wherein:

the at least one alignment member comprises a left alignment member and a right alignment member; and the left alignment member and the right alignment member are identical.

14. The free float handguard assembly of claim 11, wherein the threaded portion comprises an insert that is a separate component from the outer member.

15. The free float handguard assembly of claim 14, wherein the insert is metallic and outer member comprises a polymer material.

16. The free float handguard assembly of claim 15, wherein the insert is overmolded as a permanent component of the outer member.

17. The free float handguard assembly of claim 11, wherein the outer member comprises a polymer material.

18. The free float handguard assembly of claim 11, wherein the at least one alignment member comprises two alignment members.

19. The free float handguard assembly of claim 18, wherein the two alignment members are connected to one another using a plurality of fasteners that pass through the outer member.

20. A free float handguard assembly for a firearm comprising:

an outer member comprising a rear cavity;

a barrel nut disposed within the rear cavity; and at least one alignment member, wherein:

the at least one alignment member aligns the outer member relative to the firearm; and the outer member comprises a threaded portion that is removably attached to the barrel nut.

* * * * *